US010086380B2

(12) United States Patent
Yamamoto et al.

(10) Patent No.: US 10,086,380 B2
(45) Date of Patent: Oct. 2, 2018

(54) SHREDDING RECYCLABLE MATERIAL CONTAINING INFORMATION

(75) Inventors: David Yamamoto, Paris (CA); Justin Johns, South Yarra (AU); Constantin Vasilescu, Kitchener (CA); Derek Pepino, Cambridge (CA); Brent Allen, Sheffield (CA)

(73) Assignee: SHRED-TECH CORPORATION, Ontario (CA)

( * ) Notice: Subject to any disclaimer, the term of this patent is extended or adjusted under 35 U.S.C. 154(b) by 847 days.

(21) Appl. No.: 13/818,069

(22) PCT Filed: Jan. 13, 2012

(86) PCT No.: PCT/IB2012/000201

§ 371 (c)(1),
(2), (4) Date: Sep. 16, 2013

(87) PCT Pub. No.: WO2012/095750

PCT Pub. Date: Jul. 19, 2012

(65) Prior Publication Data

US 2014/0166789 A1 Jun. 19, 2014

Related U.S. Application Data

(60) Provisional application No. 61/433,064, filed on Jan. 14, 2011.

(51) Int. Cl.
*B02C 18/00* (2006.01)
*B02C 18/16* (2006.01)
(Continued)

(52) U.S. Cl.
CPC ..... *B02C 18/0007* (2013.01); *B02C 18/16* (2013.01); *B02C 21/026* (2013.01);
(Continued)

(58) Field of Classification Search
CPC ..... B02C 18/0007; B02C 18/2283; B02C 2018/0046; B02C 2018/003; B02C 23/02;
(Continued)

(56) References Cited

U.S. PATENT DOCUMENTS 1,321,380 A 1/1919 Liggett
2,828,082 A * 3/1958 Vander Veen ..... B65F 3/00 241/101.741

(Continued)

FOREIGN PATENT DOCUMENTS

CA 2340841 12/2001
DE 62 727 C 4/1891

(Continued)

OTHER PUBLICATIONS

Office Action dated Sep. 19, 2014, received in corresponding Canadian Application No. 2,813,487, 3 pages.

(Continued)

*Primary Examiner* — Anthony Stashick
*Assistant Examiner* — Onekki Jolly
(74) *Attorney, Agent, or Firm* — Foley & Lardner LLP

(57) ABSTRACT

A shredder system and methods for shredding recyclable material including a primary shredder that shreds recyclable material into a first larger shred size and a secondary shredder that shreds recyclable material into a second smaller shred size material. The secondary shredder includes a rotor and a knife that meshes with the rotor to cause all of the first larger shred size material to be further shredded to the second smaller shred size material. The secondary shredder may also include a diverter mechanism capable of diverting the first larger shred size material. Either the diverter mechanism or the knife can move relative to the rotor to create an opening that allows the first larger shred size material to avoid being further shredded into the second (Continued)

smaller shred size material. The shredder system may be disposed in a motor vehicle.

27 Claims, 20 Drawing Sheets

(51) Int. Cl.
*B02C 21/02* (2006.01)
*B02C 18/14* (2006.01)
*B02C 18/18* (2006.01)

(52) U.S. Cl.
CPC ..... *B02C 21/02* (2013.01); *B02C 2018/147* (2013.01); *B02C 2018/188* (2013.01)

(58) Field of Classification Search
CPC ..... B02C 18/2225; B02C 23/08; B02C 18/16; B02C 21/026; B02C 2018/188; B02C 2018/147; B02C 18/182; B02C 2018/0023; B02C 25/00
USPC ..... 241/29, 36, 81, 100, 101.5, 101.71, 158, 241/225, 236
See application file for complete search history.

(56) References Cited

U.S. PATENT DOCUMENTS 2,925,079 A 2/1960 Saxe
2,954,175 A 9/1960 Humphrey et al.
4,046,325 A 9/1977 Tucsok et al.
4,056,107 A 11/1977 Todd et al.
4,133,489 A 1/1979 Maillet
4,640,659 A * 2/1987 Parks ..... B65F 3/22 100/98 R
4,717,085 A * 1/1988 Crane ..... B02C 18/0007 241/236
4,750,437 A 6/1988 Rouse
4,782,729 A 11/1988 Mathot
5,065,947 A * 11/1991 Farnsworth ..... B02C 18/0007 241/27
5,542,617 A * 8/1996 Rajewski ..... B02C 13/04 241/101.761
5,601,239 A 2/1997 Smith et al.
5,636,801 A * 6/1997 Kroger ..... B02C 18/0007 241/167
5,871,162 A * 2/1999 Rajewski ..... B02C 13/04 241/100
5,904,305 A * 5/1999 Kaczmarek ..... B02C 18/14 241/157
6,450,427 B1 9/2002 Maynard
6,550,701 B1 4/2003 Chang
6,588,691 B2 7/2003 Yamamoto et al.
6,719,226 B2 * 4/2004 Rajewski ..... B02C 13/04 241/101.741
RE40,126 E * 3/2008 Rajewski ..... B02C 18/0007 241/223
7,637,448 B2 * 12/2009 Hartnett ..... B02C 18/0007 241/236
7,757,987 B2 * 7/2010 Kolbet ..... B02C 18/0007 241/101.2
2002/0023977 A1 * 2/2002 Nakagomi ..... B02C 18/142 241/236
2003/0025019 A1 * 2/2003 Coulter ..... D01G 11/04 241/236
2004/0104289 A1 6/2004 Schwelling
2005/0040264 A1 2/2005 Castronovo
2005/0051650 A1 3/2005 Watanabe
2005/0109866 A1 * 5/2005 Hunag ..... B02C 18/182 241/295
2006/0032957 A1 2/2006 Kolbet et al.
2007/0108324 A1 5/2007 Castronovo
2008/0099591 A1 5/2008 Cerra et al.
2010/0193619 A1 8/2010 Robinson et al.
2011/0167715 A1 7/2011 French et al.
2011/0186667 A1 8/2011 Wark
2012/0006920 A1 1/2012 Weidman et al.

FOREIGN PATENT DOCUMENTS

DE 36 12 431 A1 10/1987
EP 1 166 877 A1 1/2002
GB 1 439 103 A 6/1976
JP 09-029118 2/1997
JP 11-042468 A 2/1999

OTHER PUBLICATIONS

Patent Examination Report No. 1 dated Aug. 8, 2014, in corresponding Australian Patent Application No. 2012206372, 4 pages.
Supplementary European Search Report dated Jul. 30, 2014, received in corresponding European Application No. 12734061.0.
Patent Examination Report No. 3 dated May 7, 2015, received in corresponding Australian application No. 2012206372, 3 pages.
"DDS Plant Based Information Destruction System", Shred-Tech Brochure.
"HSM TriShredder 6060", Brochure for Office Technogy, HSM GmbH & Co. KG.
International Search Report and Written Opinion recieved in connection with international application No. PCT/IB2012/000201; dated Aug. 14, 2012.
Drawings of product offered for sale by Shred-Tech to a third party in the United States on Aug. 1, 1997.
Shred-Tech ST-20 Shredder System, Merck Medco Installations; Flyer.
Video found at http://www.youtube.com/watch?v=Zj5lbHkx90s.
Notification Concerning Transmittal of International Preliminary Report on Patentability dated Jul. 25, 2013, as received in corresponding International Patent Application No. PCT/IB2012/000201.

* cited by examiner

SHREDDING RECYCLABLE MATERIAL CONTAINING INFORMATION

CROSS REFERENCE TO RELATED APPLICATIONS

The present application is a National Stage of International Application No. PCT/IB2012/000201 filed on Jan. 13, 2012, which claims the benefit under 35 U.S.C. § 119(e) of U.S. Provisional Application No. 61/433,064, filed on Jan. 14, 2011, the contents of which are hereby incorporated by reference in their entirety entireties into the present disclosure.

BACKGROUND

Field of Embodiments

The disclosed embodiments relate generally to an apparatus and methods for shredding recyclable material, such as paper.

Description of Related Art

Material containing information, especially recyclable material, is often shredded. The recyclable material may be shredded in any suitable environment. For example, the recyclable material may be shredded in a motor vehicle. A typical motor vehicle used to shred this recyclable material typically includes a compartment with a bin lifting device to load the recyclable material into the compartment, a shredder to shred the recyclable material in the compartment, a discharge conveying/packing element to pack the shredded recyclable material into a storage area within the compartment, an unloading device for unloading the shredded material from the storage area and a control system for controlling the motor vehicle. Other motor vehicles may additionally include a feeding element that includes a conveyor or a feed drum to control the input rate of the recyclable material into the compartment.

It can be desirable to shred recyclable material to a smaller size than a standard shred size, due to customer requirements and/or for commercial advantage, particularly, if it can be done at a less expensive price than competitors' prices. Additionally, the introduction of new security and privacy regulations and laws are changing the size to which the recyclable material is shredded. The demands of customers, the need to out price competitors and the introduction of the new security and privacy regulations and laws are becoming more prevalent.

Conventional shredders provide options for shredding the recyclable material to the size required for highly sensitive information. These options include two shaft shear shredders, strip shredders, single rotor shredders, hammermills and granulators.

Two shaft shear shredders include a first shear shredder and a second shear shredder. Two shaft shear shredders generally produce a width by length shred with the width generally controlled by the width of the knives on the shredders. Disadvantages result because it is difficult to control the length to which the recyclable material is shredded. An additional disadvantage is that the orientation of the recyclable material that enters the two shaft shear shredders can significantly impact the size of the shredded recyclable material. For example, when the recyclable material stands up vertically edgewise between knives on a shaft of a shredder, the interaction between the knives and the shaft causes the recyclable material to fold and pinch between the tip of the knives and a spacer, thereby resulting in the shredded recyclable material being able to unfold after shredding. Further disadvantages result because the amount of the recyclable material can adversely affect the size to which the recyclable material is shredded. For example, if a small amount of the recyclable material is loaded into the shredders, the recyclable material can be pulled through the shredders at knife tip speed to produce long strips or the recyclable material can get folded into the hooks of the knives, thereby preventing the recyclable material from being shredded to a desired shred size. Yet another disadvantage is that passing the recyclable material through a second shear shredder may not change the length of the recyclable material if the recyclable material passes through the shredder in a longitudinal direction. Moreover, another disadvantage results because the knives of the second shear shredder are more susceptible to damage when contaminants pass through the shredder than the knives of the first shear shredder due to the knives of the second shear shredder being smaller in width than the knives of the first shear shredder.

Strip shredders include two counter rotating shafts that pull the recyclable material into a nip point between two intermeshing cutting disks. The intermeshing cutting disks shear the recyclable material into strips. Shredding the recyclable material to the smaller size required for highly sensitive information is achieved by reprocessing the shreds at right angles, to the initial shred, and to a narrower width. Some strip shredders exist where three stage reduction is employed. Disadvantages result because strip shredders are designed to cut the recyclable material into long strips, but are not good at cutting the recyclable material to a desired length.

Single rotor shredders are equipped with square insert cutters that are typically on the order of 32-40 mm square. In operation, the recyclable material is pushed against a rotor so that a gouging action tears out chunks from the recyclable material and insert cutters cut against a fixed knife. A screen may be mounted below a single rotor shredder. When a screen is normally mounted below the single rotor shredder, the holes in the screen retain the recyclable material in the machine until the recyclable material is small enough to fit through the screen holes. As a result, the recyclable material recirculates through the single rotor shredder until it fits through the holes. Disadvantages result because of the increased amount of time that the recyclable material must recirculate to fit through the small holes necessary to shred the recyclable material to a high security shred size. Additional disadvantages result because a high security shred size requirement could have a significantly negative impact on throughput capacity when the screen hole size is significantly smaller than the initial first cut shred size. Yet additional disadvantages result because recirculation of the recyclable material leads to generating dust and heat. Moreover, as recyclable materials frequently contain metal contaminants, recirculation may cause fires and dust explosions in the presence of contaminants that generate sparks. More ignition sources are created as the size of the screen holes decreases. Yet another disadvantage results because obtaining the smaller shred size for highly sensitive information requires the screen to be changed to a screen having smaller holes. Changing the screen is time consuming and difficult, if not impossible, in some designs because it could require physical access through a shredded material storage area to access the shredder. When a screen is not mounted below the single rotor shredder, disadvantages result because single rotor shredders do not tightly control the rotor to fixed knife clearance, thereby allowing the recyclable material to pass through the single rotor shredder without being shredded.

Hammermills are single rotor shredders with hammers mounted on the periphery of the rotor that turn at a high speed (on the order of 900-3600 RPM). When the hammers impact relatively stationary recyclable material, chunks of the recyclable material are torn away. A sizing screen is placed at the bottom of the hammermill and the recyclable material cannot pass through the screen until the recyclable material is smaller than the holes in the screen. Disadvantages result because the recyclable material must be recirculated to reach a size where the recyclable material can pass through the holes in the screen, thereby increasing shred time and generating dust and heat. Additional disadvantages result because reduced screen hole size reduces throughput capacity. Moreover, the recirculation may cause fires and dust explosions. Further disadvantages result when the recyclable material is metal because the hammers may cause the recyclable material to ball up. Once balled up, the recyclable material may never reach a size that is small enough to pass through the holes in the screen. Yet another disadvantage results when the hammers are dull as the dullness causes inefficient shredding, leads to longer shred time, lowers throughput and creates more dust. Additional disadvantages result because hammermills must be meter fed because they are susceptible to rotor jamming if overloaded.

Granulators are high speed single shaft knife cutters that consist of a high speed rotor (450-3600 rpm) with straight rotor blades that cut against fixed straight blade knives. The rotor is typically equipped with 3-5 fixed blades that cut against 1-3 fixed blades. A screen retains the recyclable material until the recyclable material reaches a size where it can pass through the screen holes. Granulators depend on very sharp knives for efficient production. Disadvantages result from the need to have highly trained personnel to maintain the tight knife-to-knife clearances (on the order of 0.004-0.006 inches that are required for efficient shredding. Recyclable materials are difficult for granulators since removal of metal contaminants which are inevitably contained in recyclable materials would be necessary, otherwise the keen sharp-edged blades in a granulator could quickly degrade. Additional disadvantages result as granulators must be meter fed because they are susceptible to rotor jamming if overloaded.

A need exists for improved technology, including technology that may address one or more of the above described disadvantages. For example, a need exists to give a user the option to shred recyclable material to a standard shred size or a smaller shred size required for highly sensitive information via a single pass through the system, where such a single pass produces less dust and less possible ignition sources, and for the user to pay a minimum price with minimum wear and tear of the equipment used to shred the recyclable material.

BRIEF DESCRIPTION OF THE DRAWINGS

These and other features, aspects and advantages of the disclosed embodiments will become apparent from the following description and the accompanying exemplary embodiments shown in the drawings, which are briefly described below.

DETAILED DESCRIPTION OF THE EMBODIMENTS

Figure 1:
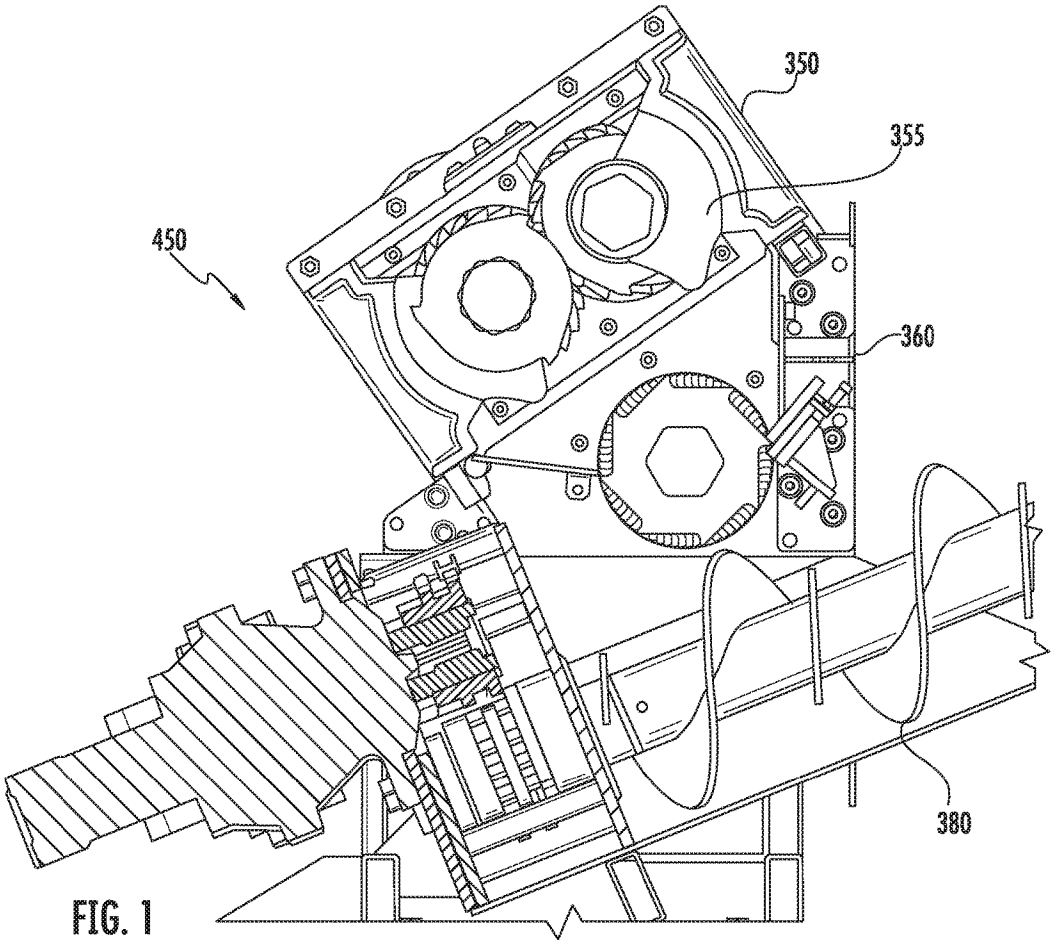
FIG. 1 a side section view through a shredder system of a motor vehicle including a primary shredder, a secondary shredder and an auger.

Presently preferred embodiments are illustrated in the drawings. An effort has been made to use the same or like reference numbers throughout the drawings to refer to the same or like parts. Although the specification refers primarily to shredding material in a motor vehicle, it should be understood that the subject matter described herein is applicable to being shredded in other environments, such as for example a warehouse or other worksite. The material to be shredded often will contain information and will be recyclable, but the invention can be applied to other materials that do not contain information and/or are not recyclable.

Description of Shred Size

FIGS. 1-12 illustrate an embodiment of a shredder system for shredding recyclable material. One example of such recyclable material is paper. However, the recyclable material may be anything else that is capable of being shredded (e.g., confidential documents, plastics, electronic media).

The shredder system can be configured to shred the recyclable material to a standard shred size and a high security shred size. The high security shred size is smaller than the standard shred size. The standard shred size can vary based on factors such as the type of shredder used. For example, the standard shred size may be larger than 0.5 inches$^2$. More preferably, the standard shred size may be ⅝ inch by 2.5 inch, ⅜ inch by 1.5 inch, 0.5 inch by 2 inch, smaller than 2 inch round or square hole when a screen is used or smaller than ⅜ inch round or square hole when a screen is used. It, of course, could be a larger shred size. The smaller shred size may be, for example, 0.5 inches$^2$. It, of course, could be a smaller shred size.

Overview of Shredder System

As shown in FIG. 1, the shredder system 450 may include a primary shredder 350, a secondary shredder 360, and an auger 380. The primary shredder 350 can shred material to the standard shred size, and the secondary shredder 360 can further shred the material to the smaller, high security shred size. A user may obtain the standard shred size by passing the recyclable material through the primary shredder 350 and then allowing the shredded material to pass to the auger 380. A user may obtain the smaller, high security shred size required for highly sensitive material by passing the recyclable material through the primary shredder 350 and then through the secondary shredder 360 in a single pass. The auger 380 can be configured to transport the shredded material away from the primary shredder 350 and the secondary shredder 360.

Primary Shredder

Figure 2A:
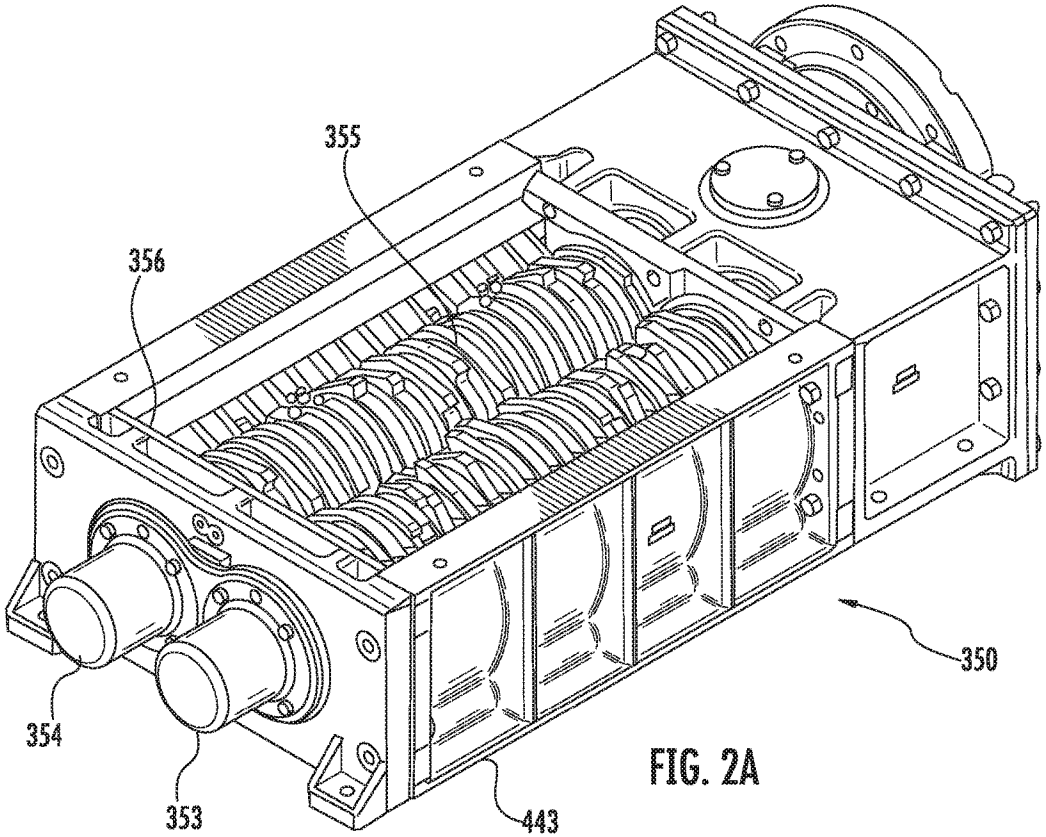
FIG. 2A is an isometric view of a primary shredder of the shredder system of FIG. 1.
Figure 2B:
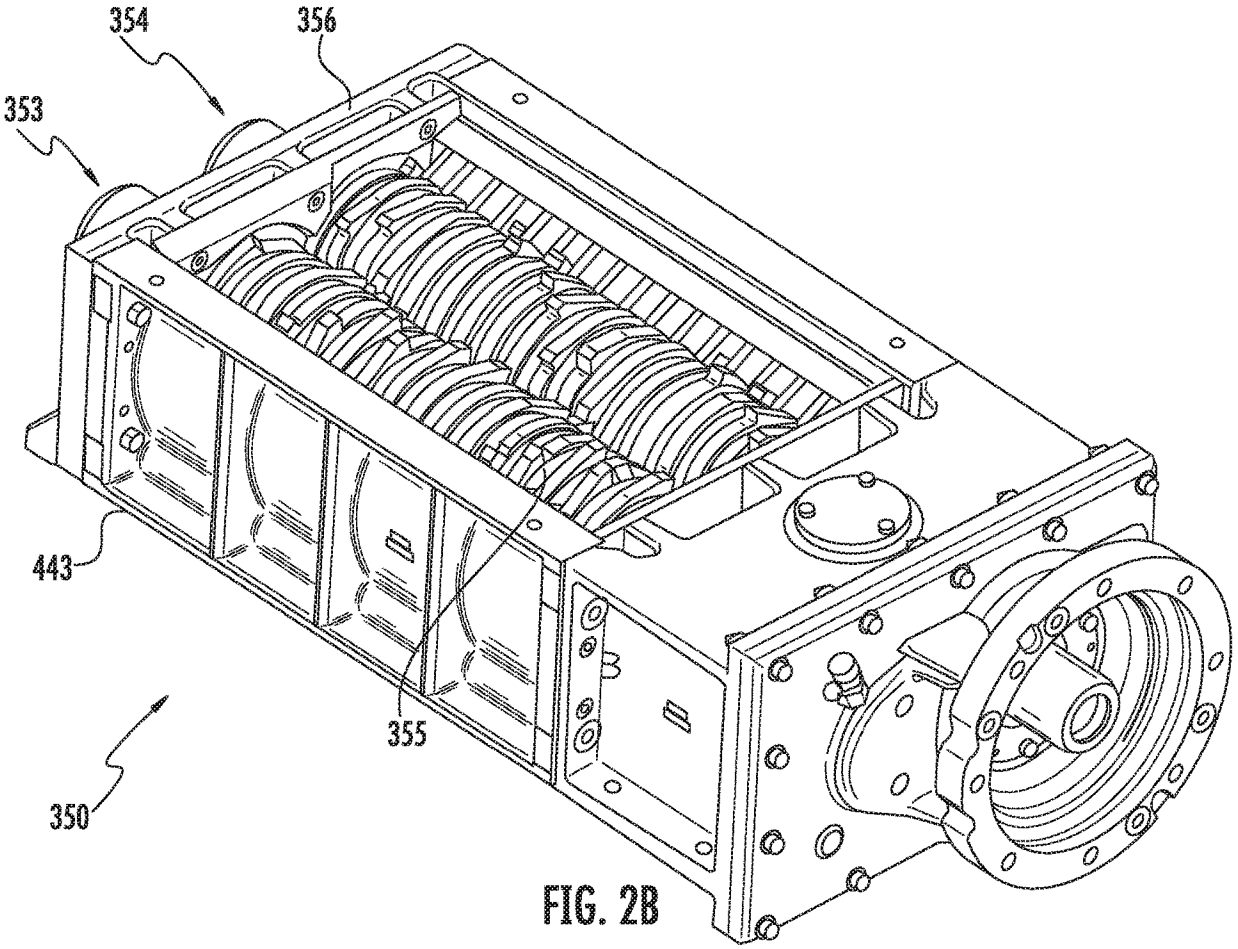
FIG. 2B is an isometric view of the primary shredder of FIG. 2A.
Figure 2C:
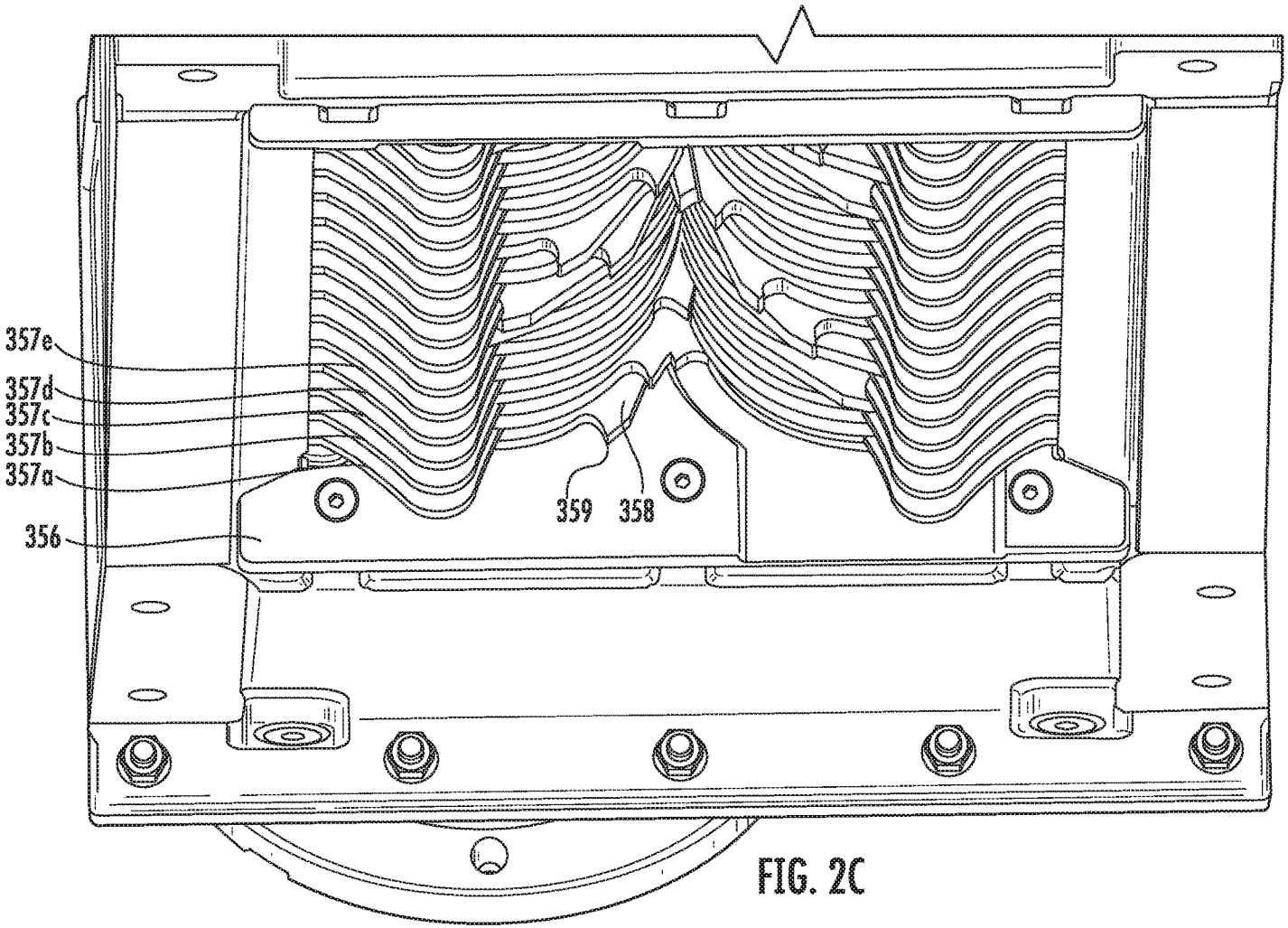
FIG. 2C is a bottom view of a bulkhead wall and a finger mechanism showing the underside of the primary shredder of FIG. 2A.
Figure 2D:
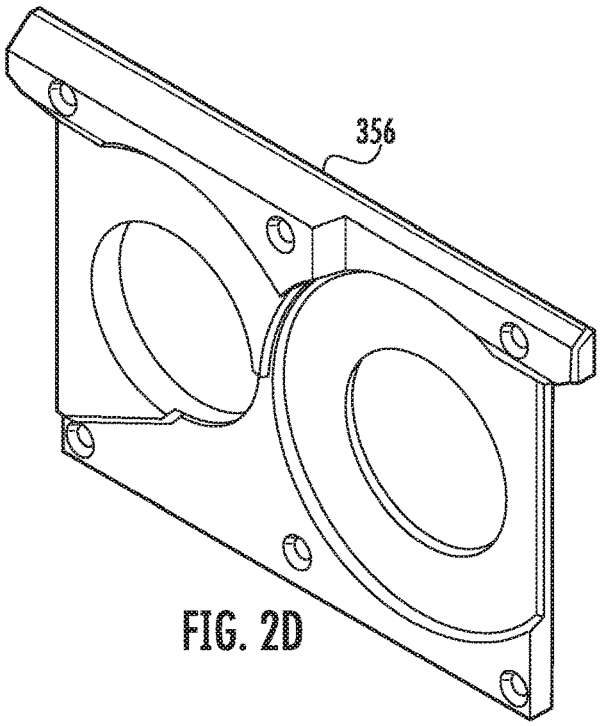
FIG. 2D is an isometric view of the bulkhead wall of the primary shredder of FIG. 2C.
Figure 2E:
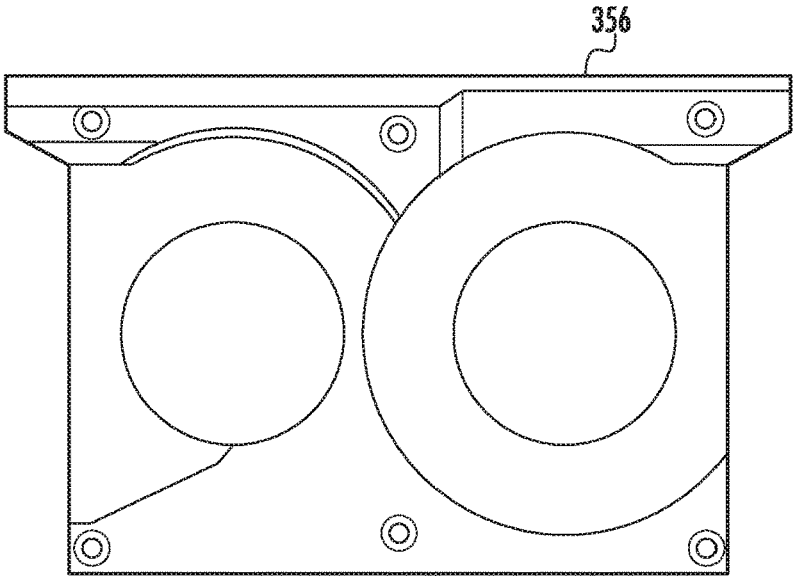
FIG. 2E is a side view of the bulkhead wall of FIG. 2C.
Figure 2F:
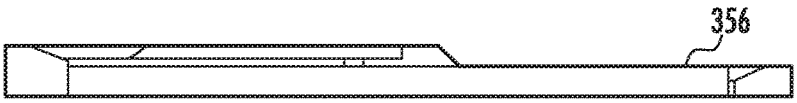
FIG. 2F is a top view of the bulkhead wall of FIG. 2C.

The primary shredder 350 preferably includes two counter rotating shafts 353, 354 (FIGS. 2A-2C). Each of the two counter rotating shafts 353, 354 includes a plurality of disc knives 358. Each disc knife 358 has a disc knife tip 359. As shown in FIGS. 1-2F the primary shredder 350 may be a standard low shaft speed, high torque shredder that has two counter rotating shafts 353, 354, except the primary shredder 350 preferably includes a modified finger mechanism 355 and a modified bulkhead wall 356.

For example, in one embodiment, the primary shredder 350 may be a Shred-Tech ST15. The ST-15 shredder includes a 110 HP hydraulic drive system driven by a power take-off mounted on the truck chassis. Each of the two counter rotating shafts is a machined hex shaft designed to maximize disc knife placement options and allow for easy disc knife removal and machine maintenance. Preferably, the distance between the counter rotating shafts is 5⅞". In a preferred embodiment, there are thirty-two disc knives, with a disc knife thickness of ⅝" and a disc knife diameter of 6¾". The shredder body of the ST-15 can be made from cast aluminum, while the fingers are made from "cast-in" steel. The cutting chamber preferably is 13"×21". While the ST-15 is provided as an example, this does not limit the type of shredder that can be used as the primary shredder 350. As previously mentioned, other standard low shaft speed, high torque shredder with two counter rotating shafts can be used, if modified to include the finger mechanism 355 and bulkhead wall 356 described below.

Finger Mechanism of Primary Shredder

FIG. 2C illustrates the finger mechanism 355 of the primary shredder 350 that is configured to prevent a build-up of the recyclable material in the space between the primary shredder 350 and the secondary shredder 360 and in between the fingers 357*a*, 357*b*, 357*c*, 357*d*, 357*e* of the finger mechanism 355. The fingers 357*a*, 357*b*, 357*c*, 357*d*, 357*e* may be positioned along the first shaft 353 and along the second shaft 354. The bottom of each finger 357*a*, 357*b*, 357*c*, 357*d*, 357*e* includes a rounded edge that protrudes radially outward of the disc knife tips 359 of the primary shredder 350 in a location outside of the outer enclosure of the cutting chamber. The fingers 357*a*, 357*b*, 357*c*, 357*d*, 357*e* lift material out from between the disc knives 358 of the primary shredder 350 and cause the shredded recyclable material to clear the disc knives 358 and drop much earlier than conventional shredders, which guides the recyclable material toward the secondary shredder 360 and prevents build up of the recyclable material between the primary shredder 350 and the secondary shredder 360. The number of fingers shown and identified in FIG. 2C do not limit the number of fingers that the finger mechanism 355 may include.

Bulkhead Wall of Primary Shredder

The bulkhead wall 356 (FIG. 2A and FIGS. 2D-2F) is shaped to enclose the ends of the cutting chamber under the knives of the primary shredder 350 and out to the sidewalls 443 of the primary shredder 350 down to the round edge of the fingers 357*a*, 357*b*, 357*c*, 357*d*, 357*e*. The bulkhead wall 356 provides a substantially continuous surface and eliminates the apertures at either end of the cutting chamber where recyclable material could lodge and build-up.

Position of Primary Shredder Relative to Secondary Shredder

Figure 3:
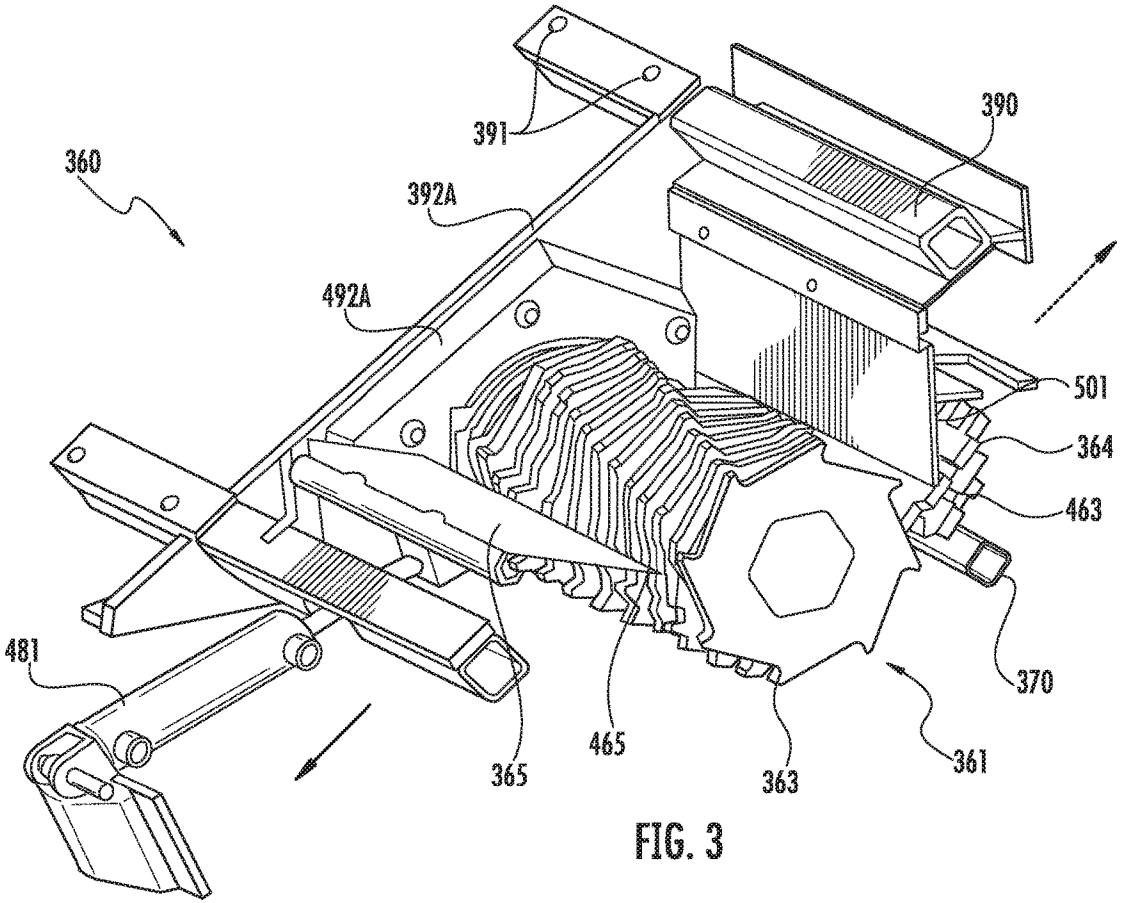
FIG. 3 is a partial isometric view of a secondary shredder of the shredder system of FIG. 1.

As seen in FIG. 1, the primary shredder 350 can be fixed over and mounted to the secondary shredder 360. For example, as seen in FIG. 3, the secondary shredder 360 may include a mounting structure 390 that allows the primary shredder 350 to mount to the secondary shredder 360 via any suitable fastening mechanism (not shown) that fastens into fastener holes 391 of the mounting structure 390. The space between the primary shredder 350 and the secondary shredder 360, when the primary shredder 350 is mounted to the secondary shredder 360, is structured such that the recyclable material continuously flows from the primary shredder 350 to the secondary shredder 360. As a result, the recyclable material does not buildup and cause jams that are difficult to clear without disassembling the shredder system 450. A door forms part of a back wall 501 (FIGS. 3, 5A and 5C) of the secondary shredder 360. The door of the back wall 501 may be removed to provide access to the space between the primary shredder 350 and the secondary shredder 360.

Secondary Shredder

The secondary shredder 360 preferably includes one rotor 361 (FIG. 3). As seen in FIG. 5A, the secondary shredder 360 and its individual components preferably are contained in an enclosure 362. The back wall 501 forms one side of the enclosure 362. End walls 392A, 392 B are located on opposite sides of the enclosure 362 and are adjacent to the back wall 501. A diverter mechanism 365 forms the fourth side of the enclosure 362. Bulkhead walls 492A, 492B may be bolted into end walls 392A, 392B, respectively. As shown in FIGS. 3-6, the secondary shredder 360 includes the rotor 361 and a fixed knife 364 that interacts with the rotor 361. The rotor 361 cuts against the fixed knife 364 to reduce the material to a consistent shred size in a single pass with no sizing screen.

Rotor Knives

The rotor 361 includes a drive shaft 369 and rotor knives 363 that are attached or mounted to the drive shaft 369 (FIG.

3, FIG. 5A). The drive shaft 369 may be any suitable drive shaft (e.g. a hex drive shaft, a single solid rotor). If the drive shaft 369 is a hex drive shaft, the rotor knives 363 may be mounted onto the drive shaft 369. If the drive shaft 369 is a single solid rotor, the features of the rotor knives 363 may directly be machine cut into the rotor 361. Alternatively, the features of the rotor knives 363 on the drive shaft 369 could be replaceable inserts that are bolted onto the drive shaft. The rotor knives 363 may be any suitable width. For example, the rotor knives 363 may be 11.6 mm wide. Alternately, the rotor knives 363 may be 6 mm wide or 9.5 mm wide.

Figure 4A:
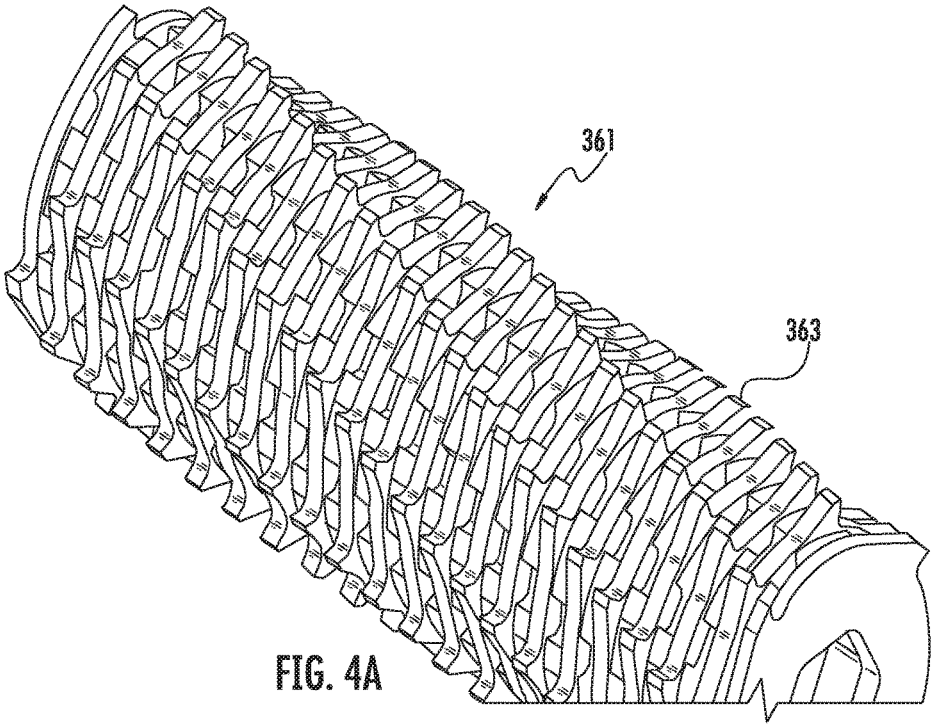
FIG. 4A is an isometric view of a rotor of the secondary shredder of FIG. 3.
Figure 4B:
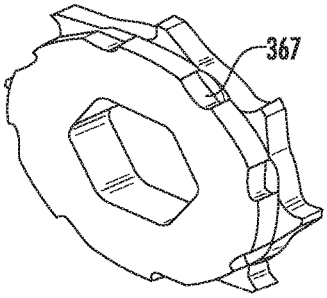
FIG. 4B is an isometric view of a rotor knife of the rotor of FIG. 4A.
Figure 4C:
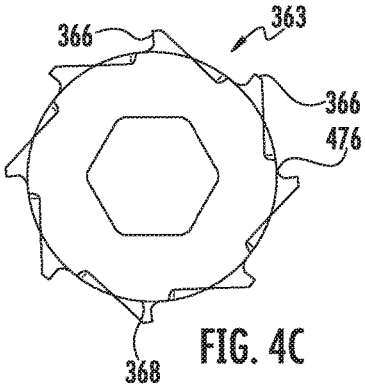
FIG. 4C is a side view of the rotor knife of FIG. 4B.
Figure 5A:
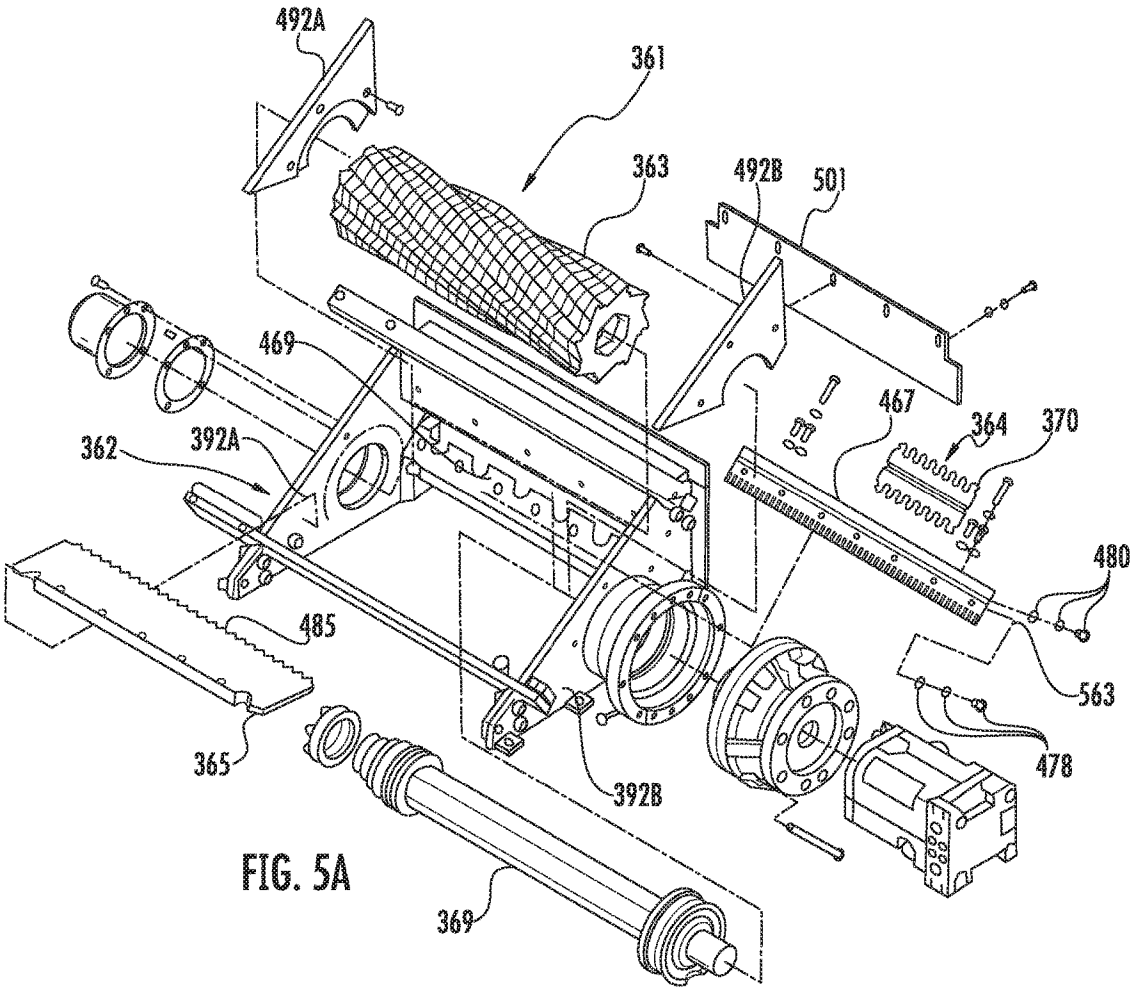
FIG. 5A is an exploded view of the secondary shredder of FIG. 3.
Figure 5B:
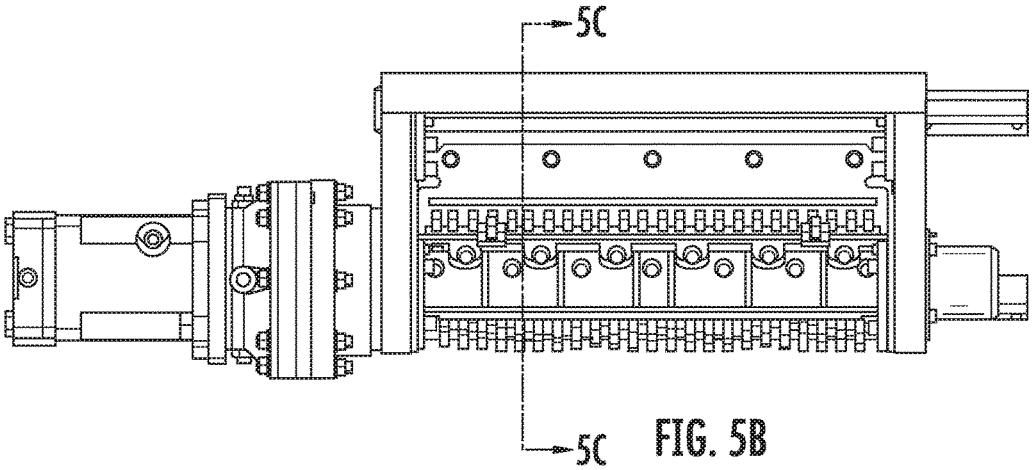
FIG. 5B is a back view of the secondary shredder of FIG. 3.

In a preferred embodiment shown in FIGS. 4B-4C, each rotor knife 363 includes a single disc with a hub 368, a plurality of knife hooks 366 and a plurality of hub hooks 367. The knife hooks 366 are located around the periphery of each rotor knife 363. The knife hooks 366 are arranged to promote crosswise alignment of long shreds and make it possible to easily grab the standard shred size material exiting the primary shredder 350. The hub hooks 367 are cut into each hub 368. The hub hooks 367 provide a secondary cutting action against the fixed knife 364, and together with the knife hooks 366 create a cutting action along the entire rotor 361. The hub hooks 367 are machined wider than the knife hooks 366 and with a shape to facilitate efficient shred ejection from the secondary shredder 360. Eight knife hooks 366 and eight hub hooks 367 may be cut into the rotor knife 363 with hub hooks 367 not aligned beside the knife hooks 366, where the hook to hook spacing is about 2.7 inches. Alternately, there may be more than eight knife hooks 366 and hub hooks 367, where an increased number of knife and hub hooks 366, 367 increases the throughput capacity by increasing the number of cuts per rotor revolution. Knife hooks 366 and hub hooks 367 are located around the periphery of the rotor 361 in small angular increments to minimize the number of knife hooks 366 and hub hooks 367 that are engaged at one time with the fixed knife 364. This minimizes the torque required to drive the rotor 361 and smoothes the torque demand on the drive system.

Figure 6:
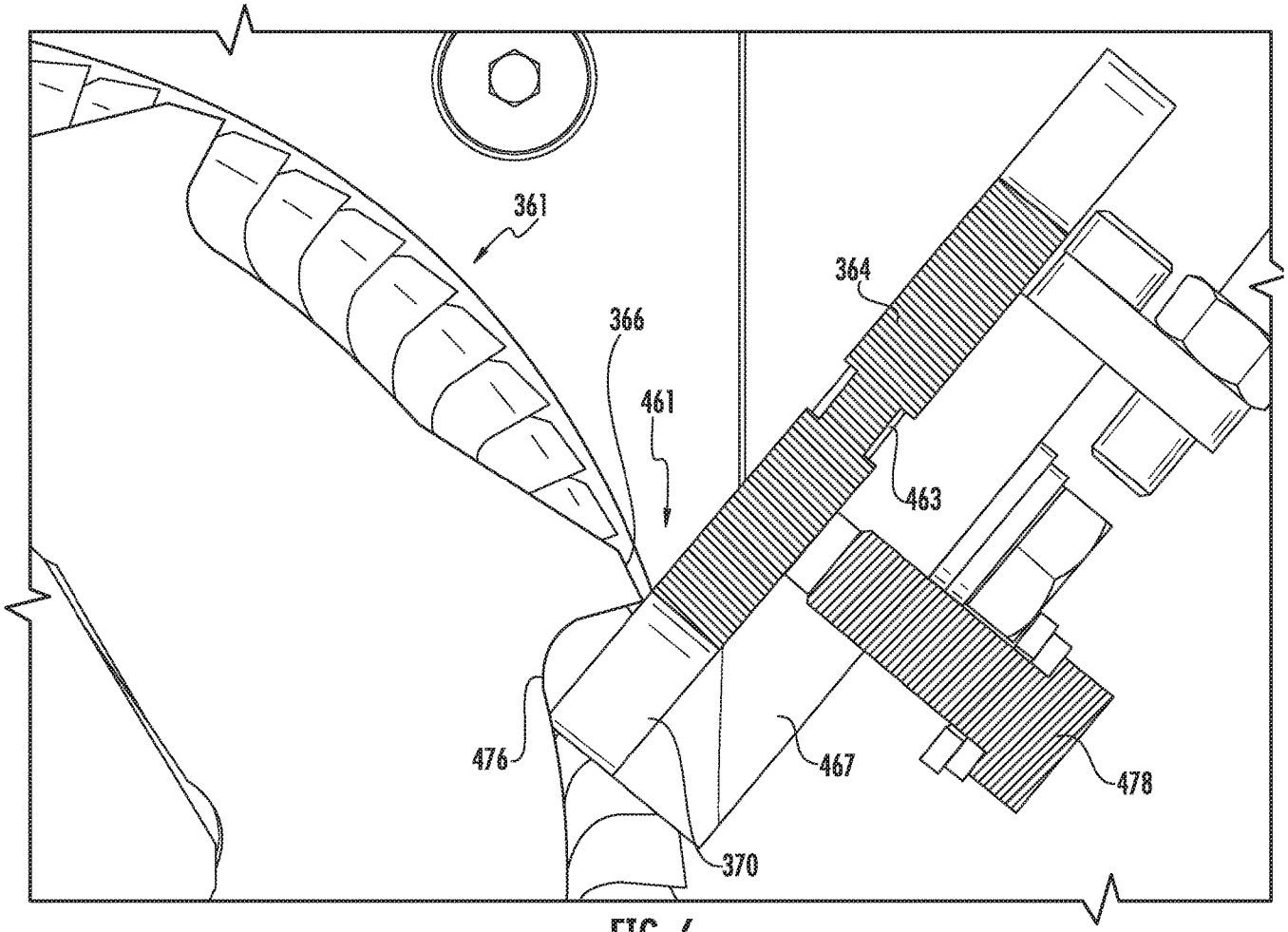
FIG. 6 is a view of the rotor of FIG. 4A interacting with a fixed knife of the secondary shredder.

As shown in FIG. 6, the knife hooks 366 interface with the fixed knife 364. The shred size of the recyclable material is controlled by the width of the rotor knives 363 and the height of the knife hooks 366 and hub hooks 367. The width and height of the knife hooks 366 and the hub hooks 367 may be decreased to produce an even smaller shred size when the hooks of the rotor 361 interact with the suitably matched fixed knife 364.

Fixed Knife

The fixed knife 364 is fixed to a knife mount 467 (FIG. 5A, FIG. 5C, FIG. 6) via a plurality of fastening elements 480 (FIG. 5A). The knife mount 467 facilitates the fixed knife 364 clearance adjustment to the rotor 361 because fastening elements 478 (FIG. 5A, FIG. 6) can be tightened or loosened to control the clearance between the fixed knife 364 and the rotor 361. The fastening elements 478 also serve to hold the fixed knife 364 in position during adjustment and prevent the fixed knife 364 from falling into the rotor 361 when the fastening elements 478 are loosened. Additionally, the fixed knife 364 is positively located on the knife mount 467 because of a key 563 (FIG. 5A) on the knife mount 467 and a mating slot in the fixed knife 364. The fixed knife 364 and the knife mount 467 are attached to a knife support 469 (FIG. 5A), which is a structural component of the secondary shredder 360. Fastening elements 478 attach the assembly of the fixed knife 364 and the knife mount 467 to the knife support 469.

The fixed knife 364 includes teeth 370. The teeth 370 may be any suitable shape. For example, the teeth may be block shaped (FIG. 5A). Two sides of the fixed knife 364 include teeth, thereby allowing the fixed knife 364 to be rotated, upon excessive wear, to make use of all four cutting edges along the fixed knife 364.

The fixed knife 364 may also include a groove 463 (FIG. 6). The groove 463 may be located down a center of the fixed knife 364 to align the fixed knife 364 with an adjustable support or knife mount 467 (FIG. 5A). The adjustable support 467 includes teeth (not shown) with the same shape as the teeth 370 of the fixed knife 364 to provide structural support for the teeth 370 on the fixed knife 364.

Interaction of Rotor with Fixed Knife

As seen in FIG. 6, the fixed knife 364 is angled toward the rotor 361 to feed material into the rotor 361. For example, the angle can be 60 degrees down from horizontal. The interaction between the fixed knife 364 and the rotor 361 is such that the tip of the teeth 370 slightly protrude past a hook root 476 of the knife hooks 366, thereby preventing the recyclable material that has not been shredded from bridging across adjacent rotor knives 363 and passing through the secondary shredder 360 without being shredded. The amount that the tip of the teeth 370 protrudes past the root of the knife hooks 366 may be adjusted, concurrently with the cutting clearance between the knife hooks 366/hub hooks 367 and the fixed knife 364. Typically, the cutting clearance is about 0.010 inches. Because no recyclable material passes through the secondary shredder 360 without being shredded, the interaction between the fixed knife 364 and the rotor 361 eliminates the need for the secondary shredder 360 to include a screen. As a result of the interaction between the fixed knife 364 and the rotor 361, a controlled shred size of the recyclable material is produced without requiring re-circulation of the recyclable material for recutting.

Figure 5C:
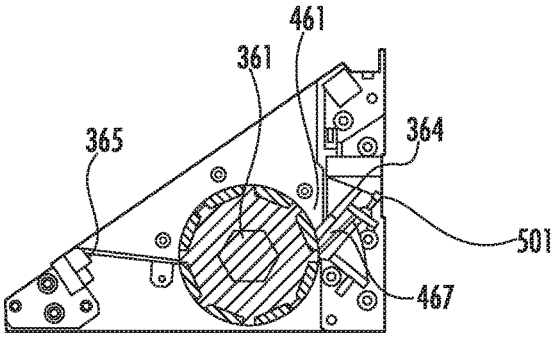
FIG. 5C is a cross section taken along the line B-B of FIG. 5B.
Figure 13:
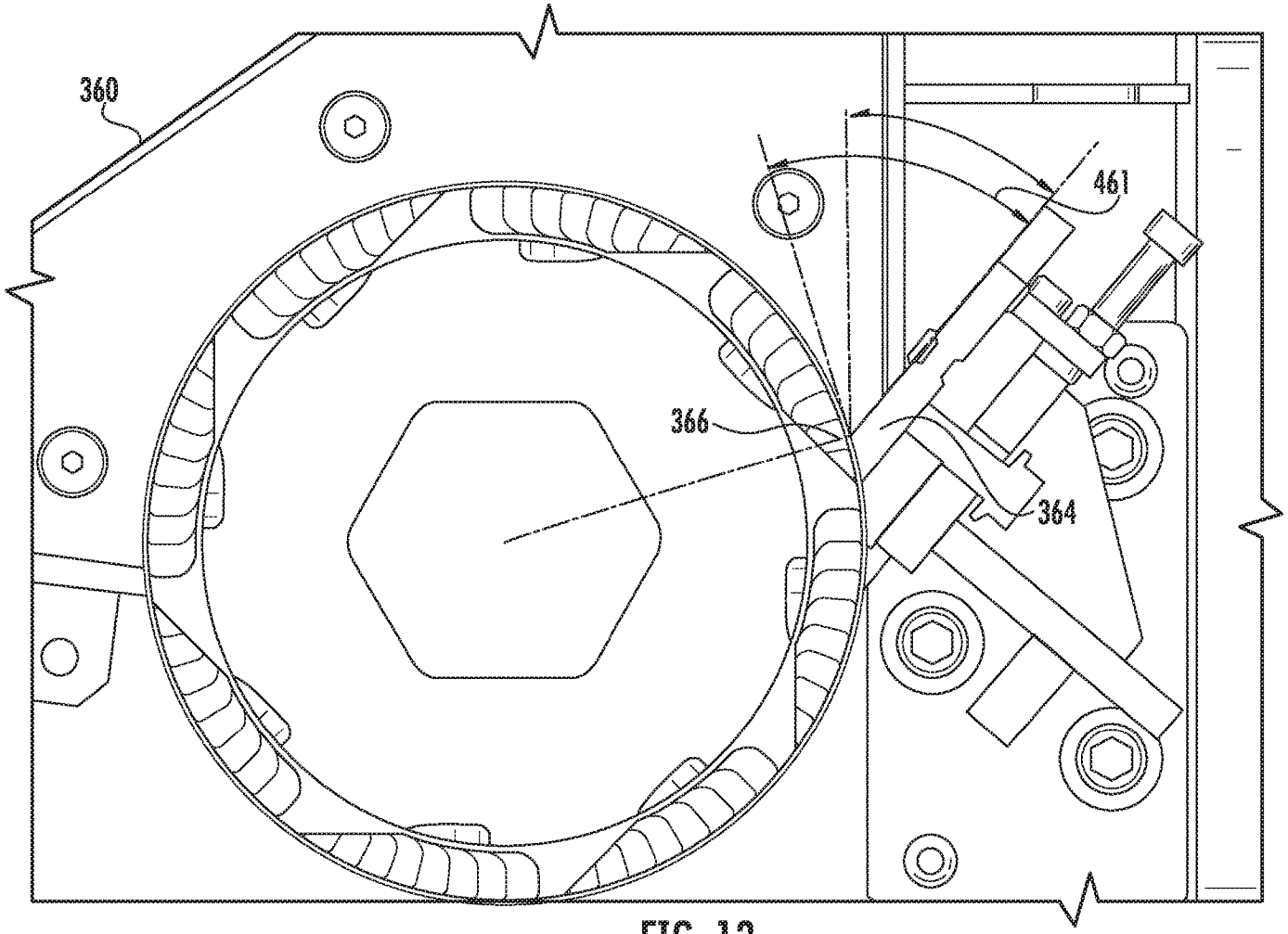
FIG. 13 is a side section view of the secondary shredder of FIG. 3.

As seen in FIG. 13, the position of the fixed knife 364 with respect to the rotor 361 is such that an acute angle 461 is defined between a surface of the fixed knife 364 and a plane, which defines a direction of the cutting force at the tips of the knife hooks 366 along the length of the rotor 361, tangent to the rotor 361 at the position where the recyclable material is shredded (FIG. 5C and FIG. 6). The acute angle 461 ensures self feeding of the recyclable material into the rotor knives 366 and the hub hooks 367 followed by a progressive shearing action between the hub hooks 367 and the fixed knife 364. The acute angle is preferably 56 degrees.

The throughput capacity of the recyclable material can be optimized by controlling the clearance between the tips of the rotor knives 363 and the door 501, which forms part of the back wall (FIG. 5A) of the secondary shredder 360. A gradual reduction in this clearance promotes the feed of the recyclable material that is above the fixed knife 364 and promotes compression of the recyclable material for a denser cut at the fixed knife 364. Additionally, the opening clearance better regulates the density of the recyclable material that is shredded. While the cross-section of the back wall 501 extends along a straight line in the vertical direction, the back wall 501 can be any suitable shape that optimizes the throughput capacity of the recyclable material. For example, the back wall 501 could be curved.

Diverter Mechanism

The secondary shredder 360 may include the diverter mechanism 365 (FIG. 5A). The diverter mechanism 365 may be any suitable mechanism, such as a diverter or a flap. In one embodiment of the shredder system 450, the diverter mechanism 365 is able to allow the recyclable material to pass from the primary shredder 350 to the auger 380 (i.e. by allowing the recyclable material to avoid being further shredded by the secondary shredder 360) and may include diverter fingers 465 (FIG. 5A). The diverter mechanism 365 can be moved between an engaged position, in which it allows the recyclable material to be further shredded by the secondary shredder 360, and a disengaged position, in which the recyclable material is allowed to pass through an opening to the auger 380. As seen in FIG. 3, a hydraulic cylinder 481 is provided to move the diverter mechanism 365 from the engaged position in the direction of the solid arrow to the disengaged position to create the opening between the diverter mechanism 365 and the rotor 361.

When the diverter mechanism 365 is in the engaged position to allow the recyclable material to be further shredded by the secondary shredder 360, the diverter fingers 465 intermesh with the rotor 361 of the secondary shredder 360 so that the recyclable material is caused to be further shredded by the secondary shredder 360. Furthermore, when the diverter mechanism 365 is in the engaged position, the rotor 361 rotates in a first direction (e.g. clockwise in FIG. 3) towards the fixed knife 364 to further shred the recyclable material.

When the diverter mechanism 365 is moved to the disengaged position to allow the recyclable material to pass to the auger 380, the diverter fingers 465 of the diverter mechanism 365 do not intermesh with the rotor 361 of the secondary shredder 360, creating an opening between the diverter mechanism 365 and the rotor 361. Furthermore, when the diverter mechanism 365 is in the disengaged position, the rotor 361 rotates in a direction towards the opening between the diverter mechanism 365 and the rotor 361. In the embodiment illustrated in FIG. 3, the direction of rotation is a second direction that is opposite to the first direction (e.g. counterclockwise). The rotation of the rotor 361 in the second direction, towards the opening, helps guide the recyclable material to the auger 380.

The diverter mechanism 365 may be driven by any suitable drive mechanism. For example, the drive mechanism may be driven by the illustrated hydraulic cylinder 481 (FIG. 3) that pushes or pulls the diverter mechanism 365 open or closed. The diverter mechanism 365 can be moved between the engaged and disengaged positions while shredding occurs. The diverter mechanism 365 can be controlled manually or by a control system 402, which will be discussed in further detail below. If the control system 402 controls the diverter mechanism 365 to move between the engaged and disengaged position while shredding is occurring, the control system 402 can be configured to cause the primary shredder 350 to pause to allow the diverter mechanism 365 to move between the engaged and disengaged positions, and to allow the rotor 361 to switch between the first and second directions. When the diverter mechanism 365 and the rotor 361 are in the desired configuration, the control system 402 can automatically cause the primary shredder 350 to resume shredding.

In another embodiment of the shredder system 450, other components within the housing of the secondary shredder 360 may be moved. For example, if the diverter mechanism 365 is fixed to the mounting structure 390, so there is no significant opening between the diverter mechanism 365 and the rotor 361, the fixed knife 364 may be moveable by a drive mechanism (not shown) to create an opening so that the recyclable material may pass from the primary shredder 350 to the auger 380 without being shredded by the secondary shredder 360. For example, the fixed knife 364 may be moved between an engaged position, in which it causes the recyclable material to be further shredded by the secondary shredder 360, and a disengaged position, in which it allows the recyclable material to pass through the opening to the auger 380. The drive mechanism in this embodiment will perform in the same way as the drive mechanism used to drive the diverter mechanism 365 in the previously described embodiment.

In this configuration, when the fixed knife 364 is in the engaged position, the fixed knife 364 interacts with the rotor 361 so that the recyclable material will be further shredded by the secondary shredder 360. Furthermore, when the fixed knife 364 is in the engaged position, the rotor 361 runs in a direction (e.g. clockwise) towards the fixed knife 364 to further shred the recyclable material.

When the fixed knife 364 is in the disengaged position to allow the recyclable material to pass to the auger 380 without being shredded by the secondary shredder 360, the fixed knife 364 does not interact with the rotor 361, creating an opening between the fixed knife 364 and the rotor 361. Furthermore, when the fixed knife 364 is in the disengaged position, the rotor 361 continues to run in the first direction (e.g. clockwise) toward the opening between the fixed knife 364 and the rotor 361. The rotation of the rotor 361 in the first direction, towards the opening, helps guide the recyclable material to the auger 380. As seen in FIG. 3, to move the fixed knife 364 from the engaged position to the disengaged position, fixed knife 364 is moved in the direction of the broken arrow to create the opening between the fixed knife 364 and the rotor 361.

Auger

The auger 380 (FIGS. 9A-10) transports the recyclable material and includes a drive unit 388, a first auger shaft 381 and a second auger shaft 382. Both the first auger shaft 381 and the second auger shaft 382 are driven by the drive unit 388. A helical flight 383 connects to the first auger shaft 381 and a helical flight 385 connects to the second auger shaft 382. The diameter of the first auger shaft 381 and the second auger shaft 382 is smaller than the diameter of conventional auger shafts. For example, the diameter of the first auger shaft 381 and second auger shaft 382 may be about 8.47 inches to 12 inches. The diameter of the first auger shaft 381 and the second auger shaft 382 is measured from the top most tip of each helical flight 383, 385 to the bottom most tip of each helical flight 383, 385. The smaller diameter of the first auger shaft 381 and second auger shaft 382 helps keep the shredder system 450 compact, allowing the shredder system 450 to fit within the shredding environment such as a motor vehicle 300.

Chain Drive Mechanism of Auger

Figure 10:
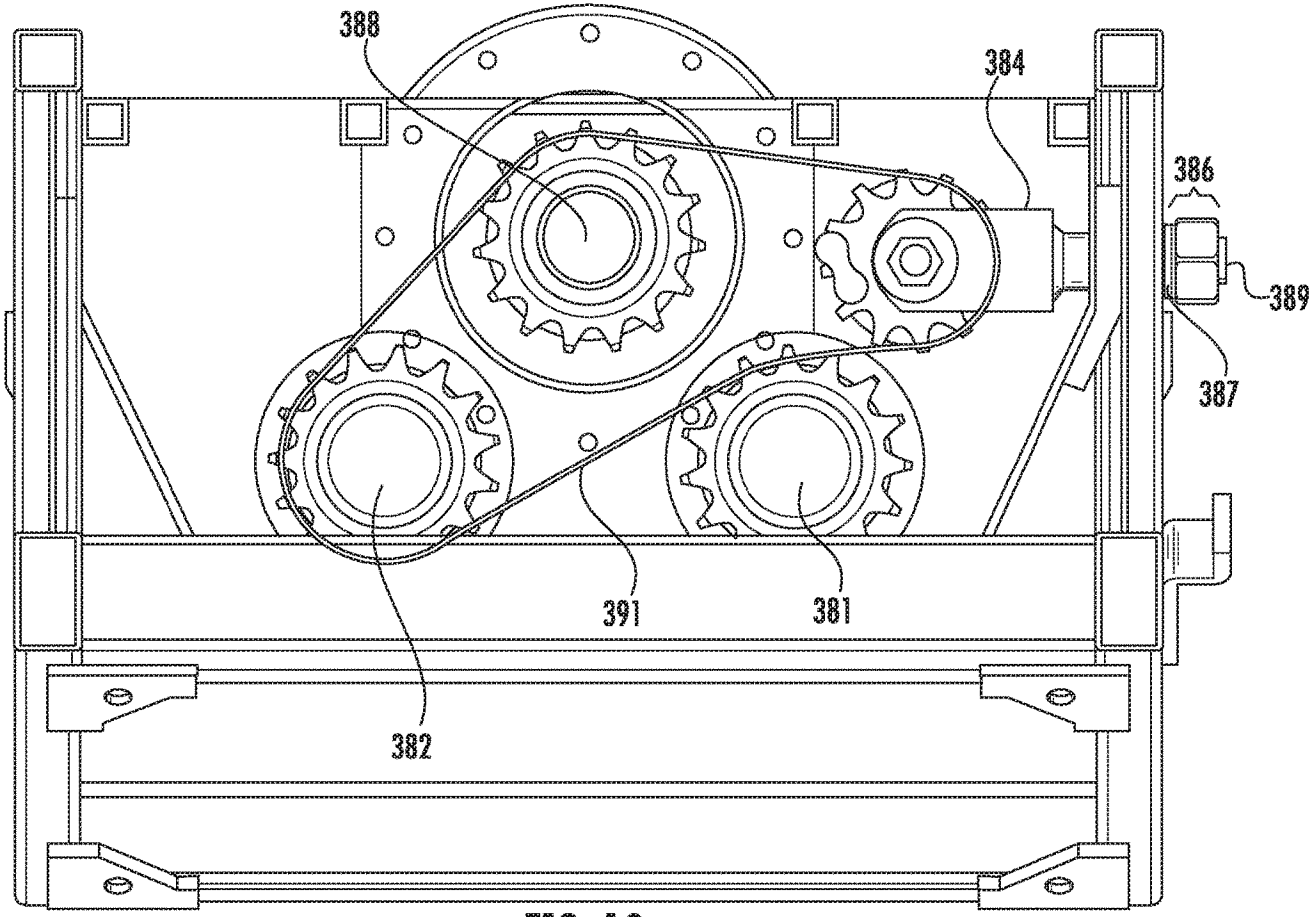
FIG. 10 is a section view of the auger of FIG. 9A showing a chain drive mechanism.

As seen in FIG. 10, the auger 380 may include a chain drive mechanism 391 that contacts the drive unit 388, the first auger shaft 381 and the second auger shaft 382. For example, the chain drive mechanism 391 may contact an upper portion of the drive unit 388, an upper portion of the first auger shaft 381 and bottom and side portions of the second auger shaft 382. Thus, the chain drive mechanism 391 connects the drive unit 388 with the first auger shaft 381 and the second auger shaft 382.

The chain drive mechanism 391 is configured to rotate the first auger shaft 381 in a first direction and the second auger shaft 382 in a second direction where the first direction is opposite to the second direction. The interaction between the chain drive mechanism 391, the drive unit 388, the first auger shaft 381 and the second auger shaft 382 causes the first auger shaft 381 to rotate in the first direction and the second auger shaft 382 to rotate in the second direction. Because the first direction is opposite to the second direction, if the first direction is clockwise, the second direction is counterclockwise. Preferably, the first auger shaft 381 rotates counterclockwise and the second auger shaft 382 rotates clockwise. The counter rotating auger shafts 381, 382 thoroughly mix the shredded recyclable material, split the shredded recyclable material stream and distribute the shredded recyclable material stream. Thus, because of the thorough mixing that results from the counter rotating auger shafts 381, 382, the probability of finding shreds that were adjacent prior to entering the shredder system 450 is decreased because the population and location of shreds that must be examined to find adjacent shreds, increases when the shredded recyclable material exits the shredder system 450. For example, when the first auger shaft 381 rotates counterclockwise and the second auger shaft 382 rotates clockwise, the shredded recyclable material is pushed perpendicular to the bottom portion of the helical flight and towards the outside of shredder system 450.

Tensioner

The chain drive mechanism 391 may also contact a tensioner 384 that is configured to self-tension the chain drive mechanism 391. For example, the chain drive mechanism 391 may contact an upper portion of the drive unit 388, an upper portion of the first auger shaft 381, bottom and side portions of the second auger shaft 382 and a side portion of the tensioner 384. The tensioner 384 is designed to balance imposed forces from chain drive mechanism 391.

The tensioner 384 includes a mechanism 386 that is configured to increase or decrease the tension in the chain drive mechanism 391. The mechanism 386 may include a plurality of washers 387, such as Belleville spring washers, that provide spring loaded tension to accommodate for wear of the chain drive mechanism 391. Additionally, the mechanism 386 may accommodate for wear of the chain sprockets and components of the tensioner 384 itself. Although the tensioner 384 is a self tensioner, the mechanism 386 may also include a nut 389 and no springs. The nut 389 may be loosened or tightened to manually alter the tension in the chain drive mechanism 391.

Control System

Figure 12:
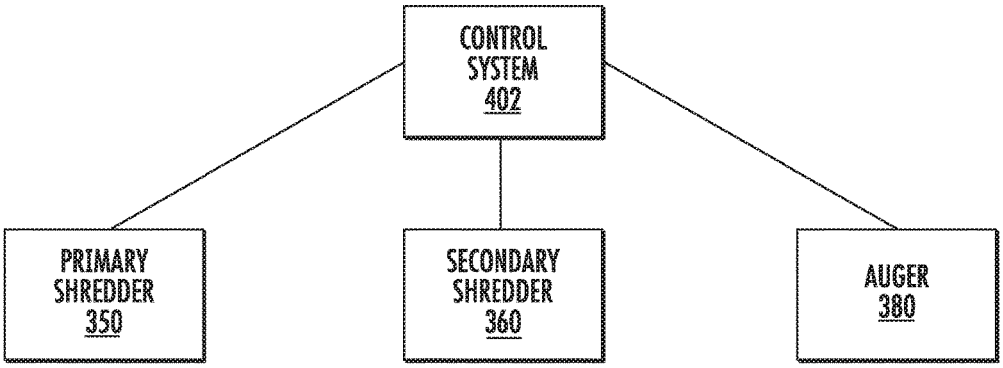
FIG. 12 is a block diagram of the control system of the shredder system of FIG. 1.

As seen in FIG. 12, the control system 402 controls the individual components of the shredder system 450. For example, the control system can control rotor shaft speed of the rotors 353, 354, 361; rotor direction of the rotors 353, 354, 361; the hydraulic cylinder 481 (to move the diverter mechanism 365), the fixed knife 364, or the auger 380. The individual components of the shredder system 450 that can be controlled by the control system 402 are not limited to the individual components mentioned above. The control system 402 may be any known computing system but is preferably a programmable, processor-based system. The control system 402 can include a microprocessor 403 having a permanent memory for storing software for the operation and monitoring of the shredder system and a reprogrammable memory for storing shredder data and system variables. For example, the control system 402 may include a microprocessor, a hard drive, random access memory (RAM), read only memory (ROM), input/output (I/O) circuitry, and any other well-known computer component. The software can comprise the procedures, algorithms and all other operation parameters and protocols for controlling the individual components of the shredder system 450. Almost any microprocessor could execute the algorithms, and the software language could be assembly code, C, C#, BASIC, or the like.

Motor Vehicle

Figure 7C:
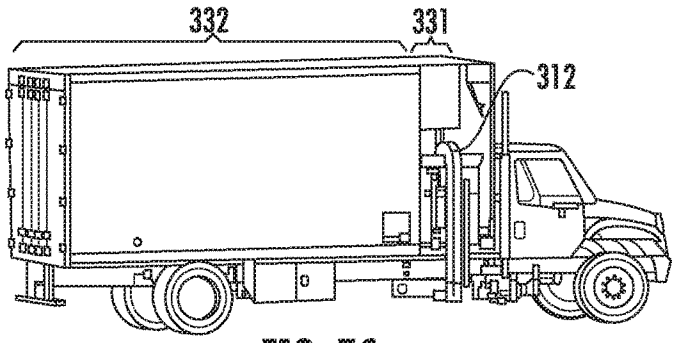
FIG. 7C is an isometric view of the motor vehicle of FIG. 7A, with a face of a bin tunnel removed for clarity.
Figure 7A:
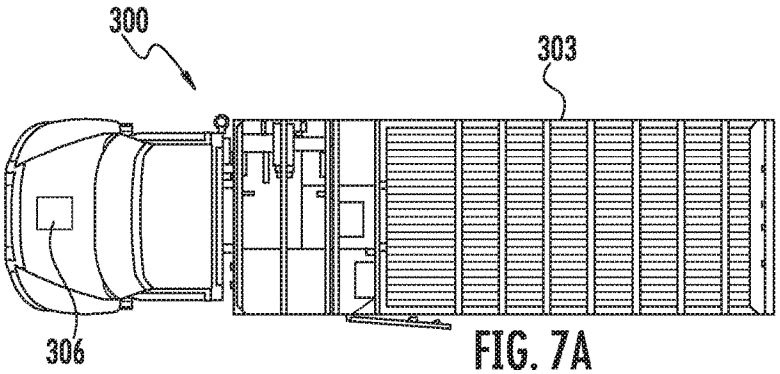
FIG. 7A is a top view of a motor vehicle with a roof and a floor removed for clarity and showing an inside compartment of the motor vehicle that will contain the shredder system of FIG. 1.

Preferably the shredder system 450 is disposed in a motor vehicle 300. Though the disclosed motor vehicle 300 is a truck, other types of vehicles could be used. As seen in FIG. 7A, the motor vehicle 300 may include a compartment 303 that is configured to receive and hold the recyclable material loaded into the motor vehicle 300 and an engine 308 for driving the motor vehicle 300.

Shredding and Collection Compartments of Motor Vehicle

Figure 7B:
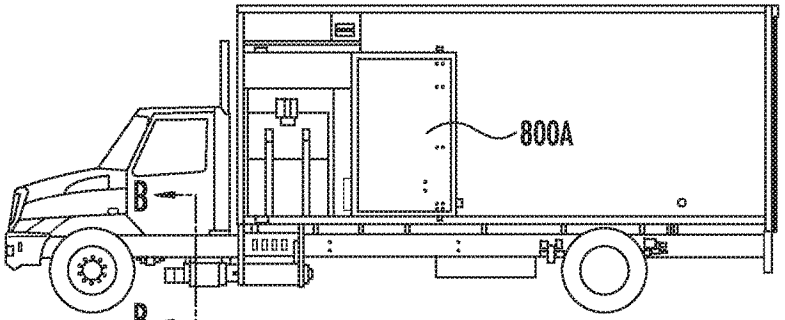
FIG. 7B is a side view of the motor vehicle of FIG. 7A.
Figure 7D:
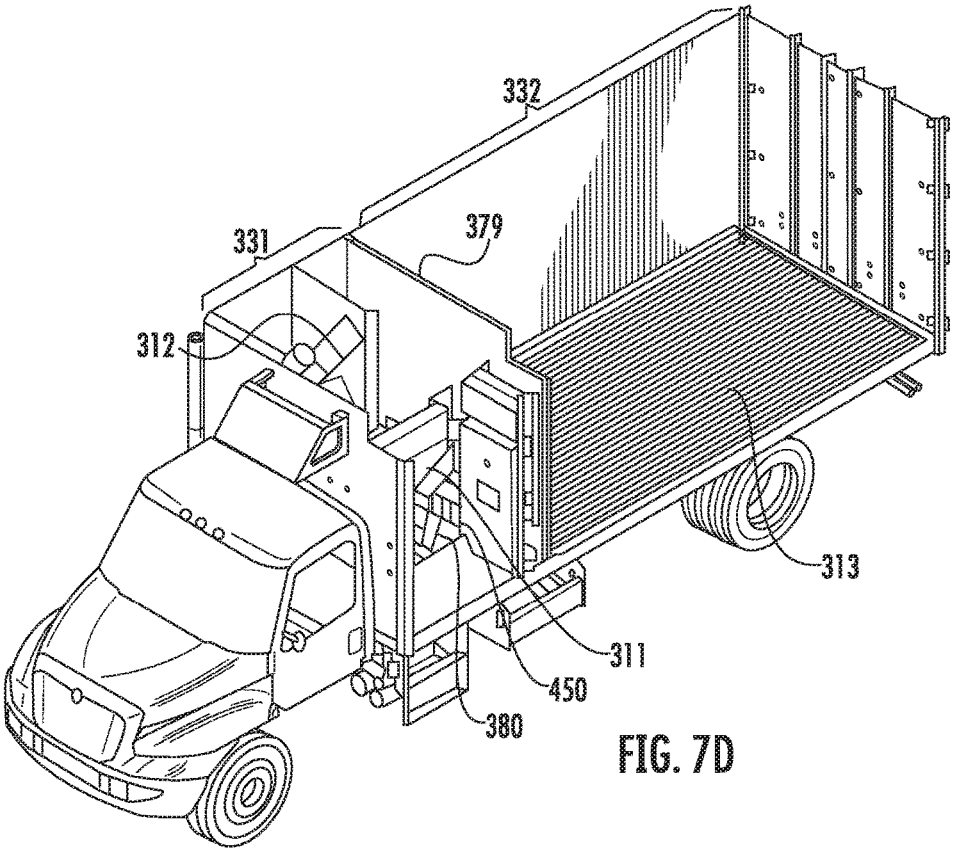
FIG. 7D is an isometric view of the motor vehicle of FIG. 7A showing an inside of a compartment of the motor vehicle.

The compartment 303 may include one or more subcompartments for receiving the recyclable material. The motor vehicle 300 also may include additional compartments that serve different purposes. For example, as seen in FIG. 7C, the motor vehicle 300 may have a shredding compartment 331 for receiving the loaded recyclable material and shredding the loaded recyclable material and a collection compartment 332 for storing the shredded recyclable material. As illustrated in FIG. 7B, the shredding compartment 331 may have a door 800A on the driver's side. In other embodiments, the shredding compartment could have a door on the passenger's side or doors on both the driver's and passenger sides. As seen in FIG. 7D, if the motor vehicle 300 includes a shredding compartment 331 and a collection compartment 332, a divider 379 may separate the shredding compartment 331 from the collection compartment 332.

Figure 7E:
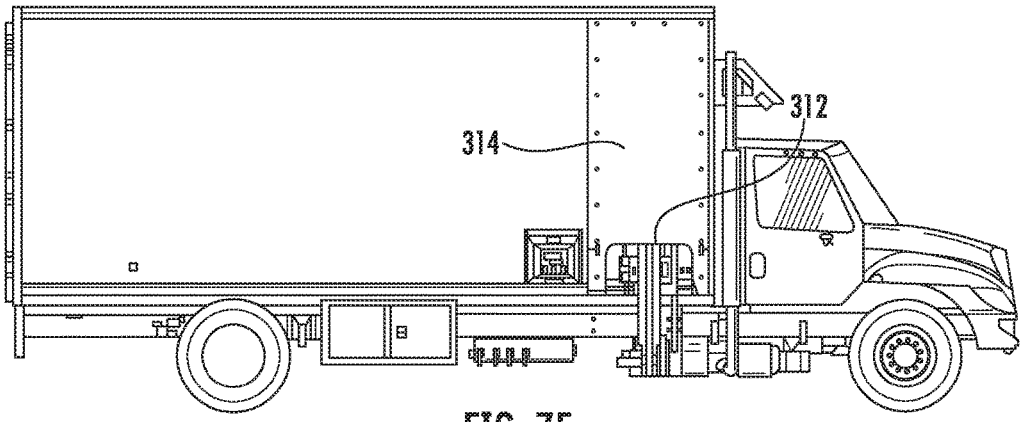
FIG. 7E is a side view of a passenger's side of the motor vehicle of FIG. 7A.
Figure 8:
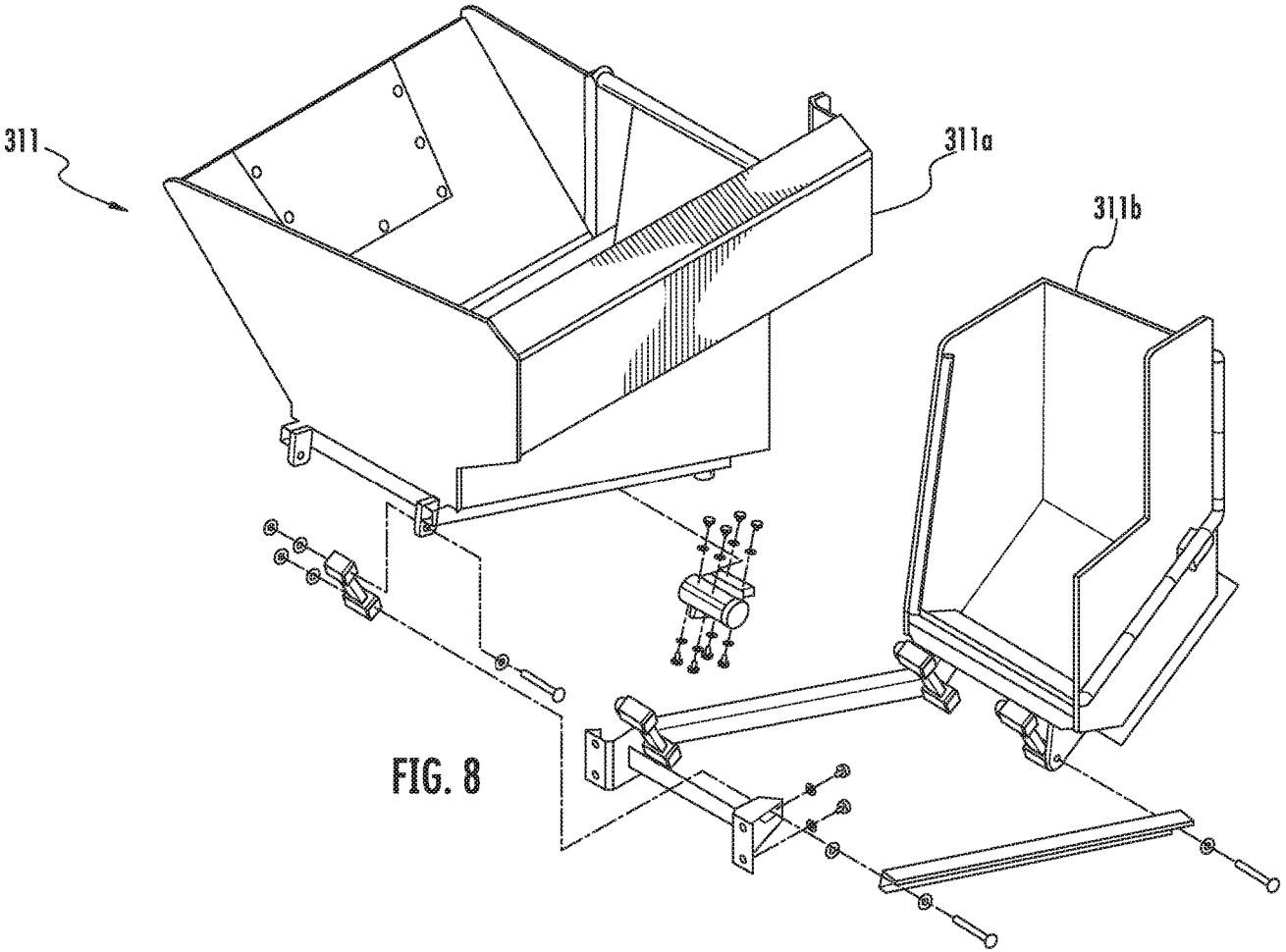
FIG. 8 is an exploded view of a vibrating hopper with a fixed hopper portion of the motor vehicle of FIG. 7A.
Figure 9A:
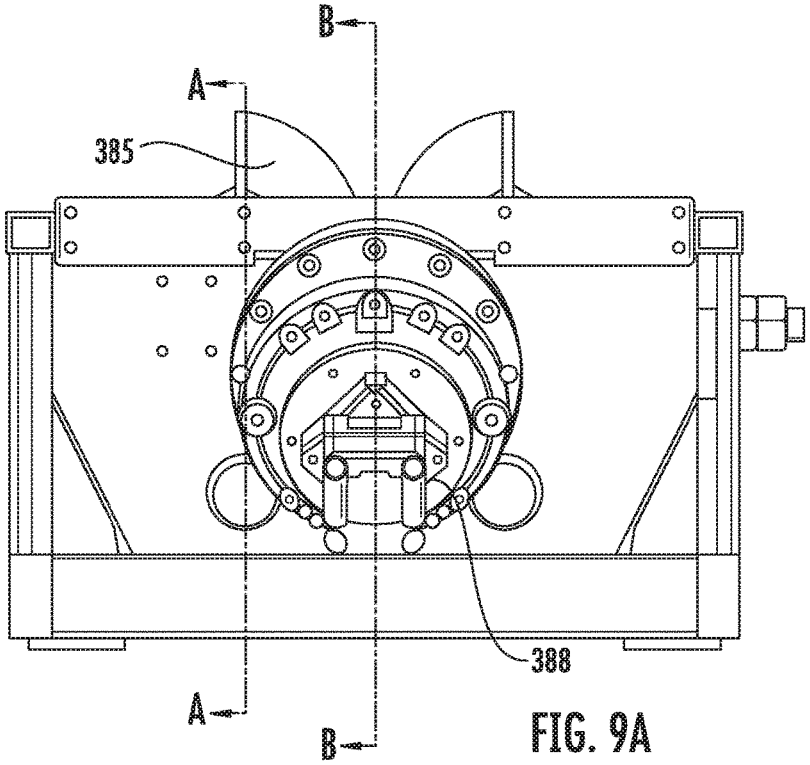
FIG. 9A is a front view of an auger of the shredder system of FIG. 1.
Figure 9B:
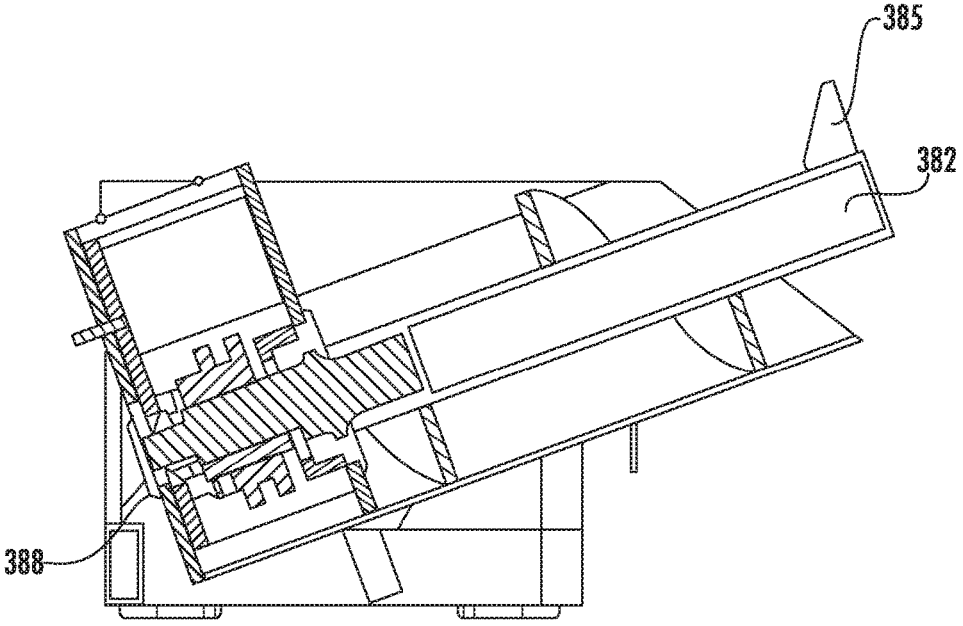
FIG. 9B is a cross section taken along line A-A of FIG. 9A.
Figure 9C:
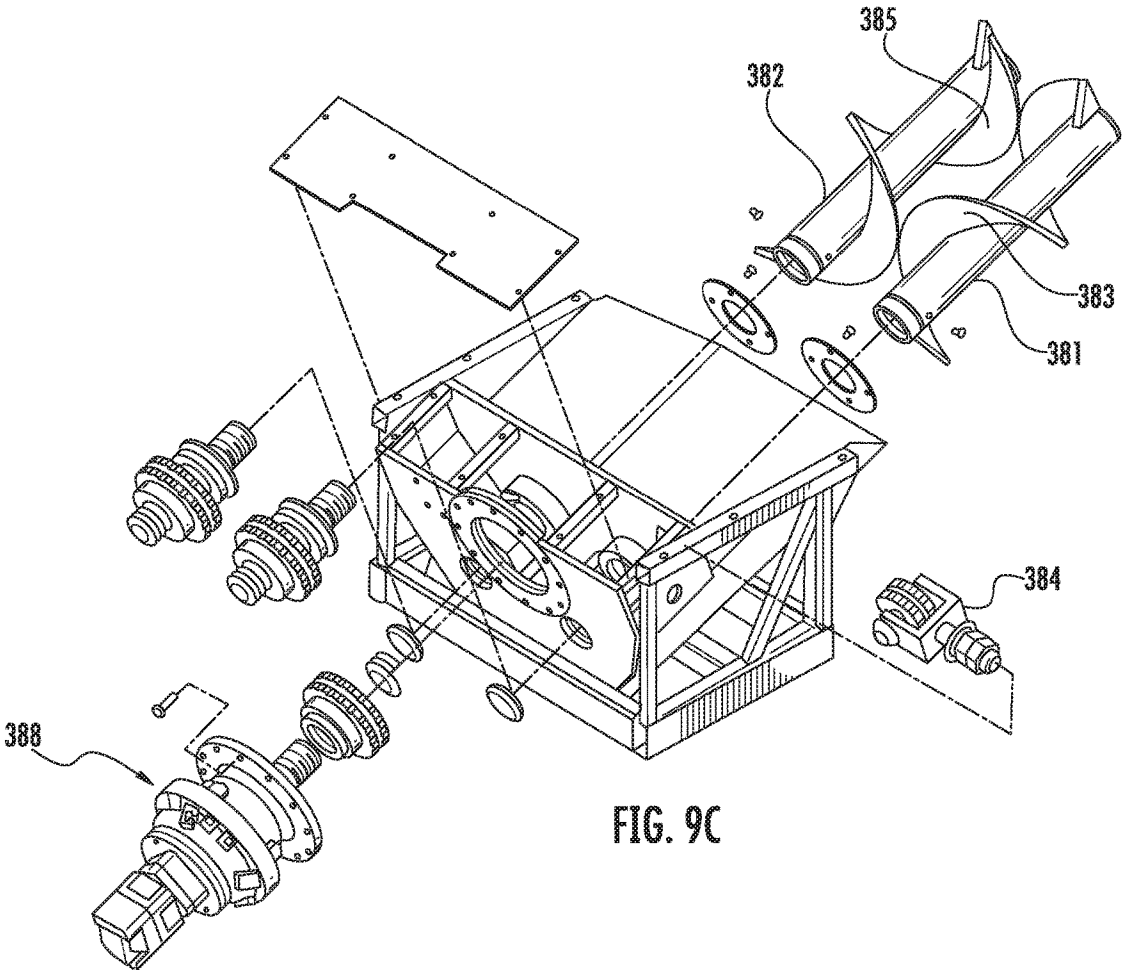
FIG. 9C is an exploded view of the auger of FIG. 9A.
Figure 11A:
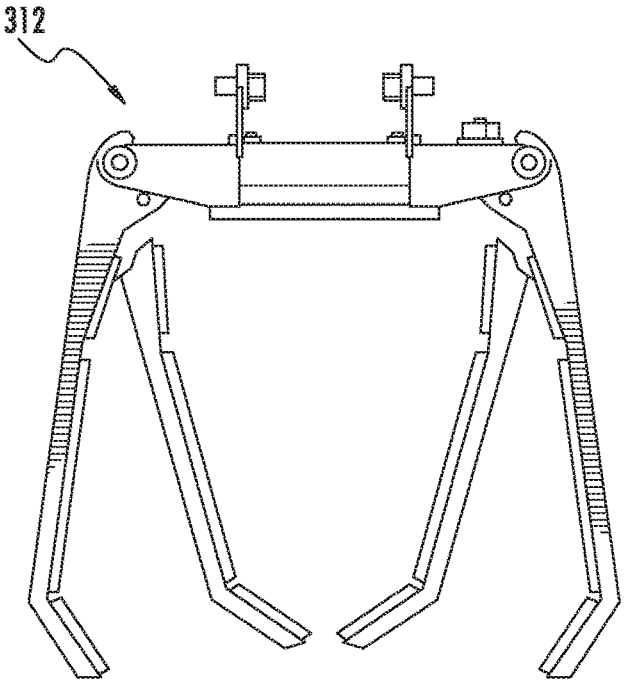
FIG. 11A is a top view of a bin lifting device of the motor vehicle of FIG. 7A.
Figure 11B:
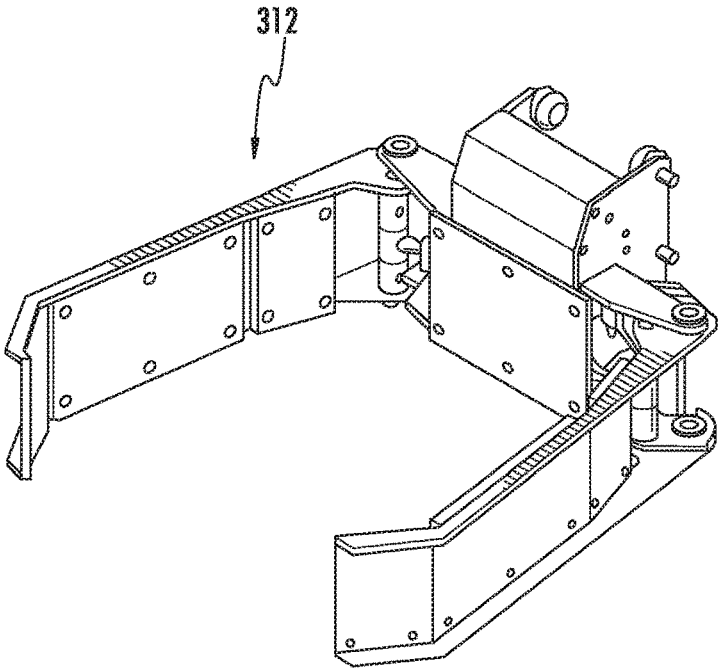
FIG. 11B is an isometric view of the bin lifting device of FIG. 11A.

The shredding compartment 331 may include auxiliary equipment for collecting and shredding the recyclable material. As seen in FIG. 7D, the auxiliary equipment may include a bin lifting device 312 for transporting the recyclable material into the compartment 331 via a chain drive and a hopper 311 to serve as a chute for receiving the recyclable material from the bin lifting device 312 (FIGS. 11A-11B). As seen in FIG. 7E, the motor vehicle 300 may include a pull out bin tunnel 314 that creates extra space for operation of the bin lifting device 312. The hopper may include a vibrating hopper 311*a* with a fixed hopper portion 311*b* (FIG. 8), a shredder system 450 for shredding the recyclable material and transporting it to the collection compartment 332 and an unloading device 313 for unloading the recyclable material from the collection compartment 332. Because of the design of the shredder system 450, the bin lifting device 312, hopper 311 and unloading device 313 may be any suitable device for loading the recyclable material into a motor vehicle, receiving the recyclable material and unloading the recyclable material from the motor vehicle, respectively. Although FIG. 7A and FIGS. 8A-8B show one example of a hopper 311, other hoppers can be used.

When the shredder system 450 is disposed on the motor vehicle 300, the smaller diameter of the first auger shaft 381 and the second auger shaft 382 helps keep the shredder system 450 compact, allowing the shredder system 450 to fit within the motor vehicle 300 without also having to modify other equipment in the motor vehicle 300 (e.g. the bin lifting device 312, the hopper 311 and the compartment 303). Because the first auger shaft 381 rotates in a direction opposite to the second auger shaft 382, the shredded recyclable material is evenly distributed within the collection compartment 332. For example, when the first auger shaft 381 rotates counterclockwise and the second auger shaft 382 rotates clockwise, the shredded recyclable material is pushed perpendicular to the bottom portion of the helical flight and toward the outside of the storage compartment 332.

Alternative Embodiments

In alternative embodiments of the shredder system, more than two shredders could be used to shred the recyclable material. Such an embodiment may include shredders that are bypassed or shredders swinging or sliding in modules. Moreover, in an alternative embodiment, the geometrical shape, size, materials used, heat treatment and surface finish of the knives could be modified.

Yet in another embodiment, a stand alone shredder system could be used. The shredder system could be supported on a higher stand and a discharge conveyor could be integrated under the secondary shredder to carry shredded recyclable material to other processing equipment such as a baler. The infeed hopper to the primary shredder could be designed to receive material from a feed conveyor. The primary shredder could be separated from the secondary shredder to facilitate the addition of material handling conveyors and magnetic separation equipment to remove metal contaminants after the primary shred operation to protect the secondary shredder from damage. Without the physical constraints of the current mobile design, additional alternative configurations of the secondary shredder are possible.

One versed in the art would appreciate that there may be other embodiments and modifications within the scope and spirit of the disclosure. Accordingly, all modifications attainable by one versed in the art from the present disclosure, within its scope and spirit, are to be included as further embodiments of the present disclosure.

What is claimed is:

1. An apparatus for shredding paper, comprising:

a primary shredder configured to shred paper into a first larger shred size material, the primary shredder including:

at least two counter rotating shafts configured to receive paper and shred paper to the first larger shred size material, each of the two counter rotating shafts having a plurality of knife tips, and a finger mechanism configured to prevent a build-up of the first larger shred size material between the primary shredder and the secondary shredder, the finger mechanism comprising a plurality of fingers with rounded edges that protrude beyond the plurality of knife tips on each of the two counter rotating shafts; and a secondary shredder configured to further shred the first larger shred size material into a second smaller shred size material, the secondary shredder including:

a rotor comprising a plurality of rotor knives, each rotor knife including a plurality of knife hooks located around a periphery thereof and a hub attached thereto, wherein the hub comprises a disc including a plurality of hub hooks located around a periphery thereof, and the hub hooks are shaped to facilitate ejection of the second smaller shred size material from the secondary shredder, and a knife configured to mesh with the rotor to cause all of the first larger shred size material to be further shredded to the second smaller shred size material in a single pass, wherein the apparatus for shredding paper is disposed in a motor vehicle.

2. The apparatus for shredding paper of claim 1, wherein the first larger shred size material is larger than 0.5 square inches, and wherein the second smaller shred size material is smaller than 0.5 square inches.

3. The apparatus for shredding paper of claim 1, wherein the primary shredder is fixed over and mounted to the secondary shredder such that the paper continuously flows from the primary shredder to the secondary shredder.

4. The apparatus for shredding paper of claim 1, wherein the knife is positioned at an acute angle to a plane tangent to the rotor.

5. The apparatus for shredding paper of claim 1, further comprising a housing configured to enclose the primary shredder and ensure all of the paper is shredded to the first larger shred size material.

6. The apparatus for shredding paper of claim 1, further comprising an auger including:

a first shaft; and a second shaft, wherein the first shaft and the second shaft are driven by a drive unit and a chain drive mechanism configured to rotate the first shaft in a first direction and the second shaft in a second direction opposite to the first direction in order to mix and distribute the shredded paper.

7. The apparatus for shredding paper of claim 1, wherein the motor vehicle comprises:

a shredding compartment configured to receive and shred paper;

a collection compartment for storing shredded paper; and an unloading device configured to unload shredded paper from the collection compartment.

8. An apparatus for shredding paper, comprising:

a primary shredder configured to shred paper into a first larger shred size material, the primary shredder including:

at least two counter rotating shafts configured to receive paper and shred paper to the first larger shred size material, each of the two counter rotating shafts having a plurality of knife tips, and a finger mechanism configured to prevent a build-up of the first larger shred size material between the primary shredder and the secondary shredder, the finger mechanism comprising a plurality of fingers with rounded edges that protrude beyond the plurality of knife tips on each of the two counter rotating shafts;

an enclosure; and a secondary shredder within the enclosure and configured to further shred the first larger shred size material into a second smaller shred size material, the secondary shredder including:

a rotor, and a knife configured to mesh with the rotor to cause all of the first larger shred size material to be further shredded to the second smaller shred size material in a single pass;

wherein:

a diverter mechanism is configured to divert the first larger shred size material and is configured to move relative to the rotor to create a diverter opening between the rotor and the diverter mechanism, the diverter opening being configured to allow the first larger shred size material to move between the rotor and the diverter mechanism without being further shredded into the second smaller shred size material, or the knife is configured to move relative to the rotor to create a knife opening between the rotor and the knife, the knife opening being configured to allow the first larger shred size material to move between the rotor and the knife without being further shredded into the second smaller shred size material.

9. The apparatus for shredding paper of claim 8, wherein the first larger shred size material is larger than 0.5 square inches, and wherein the second smaller shred size material is smaller than 0.5 square inches.

10. The apparatus for shredding paper of claim 8, wherein the primary shredder is fixed over and mounted to the secondary shredder such that the paper continuously flows from the primary shredder to the secondary shredder.

11. The apparatus for shredding paper of claim 8, wherein the knife is positioned at an acute angle to a plane tangent to the rotor.

12. The apparatus for shredding paper of claim 8, further comprising a housing configured to enclose the primary shredder and ensure all of the paper is shredded to the first larger shred size material.

13. The apparatus for shredding paper of claim 8, further comprising a control system that rotates the rotor of the secondary shredder in a first direction, towards the knife, when the first larger shred size material is further shredded to the second smaller shred size material, and rotates the rotor of the secondary shredder in a second direction opposite to the first direction, towards the diverter opening or the knife opening when the first larger shred size material avoids being further shredded into the second smaller shred size material.

14. The apparatus for shredding paper of claim 8, further comprising an auger including:

a first shaft; and a second shaft, wherein the first shaft and the second shaft are driven by a drive unit and a chain drive mechanism configured to rotate the first shaft in a first direction and the second shaft in a second direction opposite to the first direction in order to mix and distribute the shredded paper.

15. The apparatus for shredding paper of claim 8, further comprising a motor vehicle that houses the primary shredder and the secondary shredder.

16. The apparatus for shredding paper of claim 15, wherein the motor vehicle comprises:

a shredding compartment configured to receive and shred paper;

a collection compartment for storing shredded paper; and an unloading device configured to unload shredded paper from the collection compartment.

17. A method for shredding paper, comprising:

disposing a primary shredder and a secondary shredder in a motor vehicle;

shredding paper into a first larger shred size material with the primary shredder, the primary shredder including at least two counter rotating shafts configured to receive paper and shred paper to the first larger shred size material, each of the two counter rotating shafts having a plurality of knife tips, and a finger mechanism configured to prevent a build-up of the first larger shred size material between the primary shredder and the secondary shredder, the finger mechanism comprising a plurality of fingers with rounded edges that protrude beyond the plurality of knife tips on each of the two counter rotating shafts;

lifting the first larger shred size material from between the knife tips of the primary shredder; and further shredding the first larger shred size material into a second smaller shred size material in a single pass with the secondary shredder, the secondary shredder including a rotor and a knife, the rotor comprising a plurality of rotor knives, each rotor knife including a plurality of knife hooks located around a periphery thereof and a hub attached thereto, wherein the hub comprises a disc including a plurality of hub hooks located around a periphery thereof, and the hub hooks are shaped to facilitate ejection of the second smaller shred size material from the secondary shredder, wherein the knife is configured to mesh with the rotor to cause all of the first larger shred size material to be further shredded to the second smaller shred size material.

18. The method for shredding paper of claim 17, further comprising continuously providing the secondary shredder with the first larger shred size material by mounting the primary shredder over the secondary shredder.

19. The method for shredding paper of claim 17, further comprising:

receiving and shredding paper in a shredding compartment of the motor vehicle;

storing shredded paper in a collection compartment of the motor vehicle; and unloading shredded paper from the collection compartment of the motor vehicle.

20. A method for shredding paper, comprising:

shredding paper into a first larger shred size material with a primary shredder;

receiving the first larger shred size material in an enclosure, the enclosure housing a secondary shredder configured to further shred the first larger shred size material into a second smaller shred size material, the secondary shredder including:

a rotor, and a knife configured to mesh with the rotor to cause all of the first larger shred size material to be further shredded to the second smaller shred size material; and after receiving the first larger shred size material in the enclosure disposing at least one of a diverter mechanism and the knife in a first position relative to the rotor to cause the secondary shredder to further shred the first larger shred size material into the second smaller shred size material in a single pass when the at least one of the diverter mechanism and the knife is in a first position relative to the rotor; and disposing the at least one of the diverter mechanism and the knife to a second position relative to the rotor to create an opening that is between the rotor and the at least one of the diverter mechanism and the knife, the opening being configured to allow the first larger shred size material to move between the rotor and the at least one of the diverter mechanism and the knife without being further shredded into the second smaller shred size material.

21. The method for shredding paper of claim 20, further comprising:

rotating the rotor of the secondary shredder in a first direction, towards the knife, when the first larger shred size material is further shredded to the second smaller shred size material; and rotating the rotor of the secondary shredder in a second direction opposite to the first direction, towards the opening created between the rotor and the at least one of the diverter mechanism and the knife, when the first larger shred size material avoids being further shredded into the second smaller shred size material.

22. The method for shredding paper of claim 20, further comprising continuously providing the secondary shredder with the first larger shred size material by mounting the primary shredder over the secondary shredder.

23. The method for shredding paper of claim 20, further comprising disposing the primary shredder and the secondary shredder in a motor vehicle.

24. The method for shredding paper of claim 23, further comprising:

receiving and shredding paper in a shredding compartment of the motor vehicle;

storing shredded paper in a collection compartment of the motor vehicle; and unloading shredded paper from the collection compartment of the motor vehicle.

25. The apparatus for shredding paper of claim 1, wherein a diverter mechanism is configured to divert the first larger shred size material and is configured to move relative to the rotor to create a diverter opening between the rotor and the diverter mechanism, the diverter opening being configured to allow the first larger shred size material to move between the rotor and the diverter mechanism without being further shredded into the second smaller shred size material, or the knife is configured to move relative to the rotor to create a knife opening between the rotor and the knife, the knife opening being configured to allow the first larger shred size material to move between the rotor and the knife without being further shredded into the second smaller shred size material.

26. The apparatus for shredding paper of claim 8, wherein the diverter mechanism is configured to move relative to the rotor to create the rotor opening between the rotor and the diverter mechanism, the diverter opening being configured to allow the first larger shred size material to move between the rotor and the diverter mechanism without being further shredded into the second smaller shred size material.

27. The apparatus of claim 8, wherein the knife is configured to move relative to the rotor to create the knife opening between the rotor and the knife, the knife opening being configured to allow the first larger shred size material to move between the rotor and the knife without being further shredded into the second smaller shred size material.

* * * * *